US009617505B2

(12) United States Patent
Ogawa

(10) Patent No.: US 9,617,505 B2
(45) Date of Patent: Apr. 11, 2017

(54) INTERNAL CLEANING AGENT FOR DIESEL ENGINE AND CLEANING SYSTEM USING THE SAME

(71) Applicant: O2 Engineering., Ltd., Utsunomiya-shi, Tochigi (JP)

(72) Inventor: Osamu Ogawa, Utsunomiya (JP)

(73) Assignee: O2 ENGINEERING., LTD., Utsunomiya-Shi, Tochigi (JP)

( * ) Notice: Subject to any disclaimer, the term of this patent is extended or adjusted under 35 U.S.C. 154(b) by 89 days.

(21) Appl. No.: 14/390,126

(22) PCT Filed: Nov. 8, 2012

(86) PCT No.: PCT/JP2012/079042

§ 371 (c)(1),
(2) Date: Oct. 2, 2014

(87) PCT Pub. No.: WO2013/150678

PCT Pub. Date: Oct. 10, 2013

(65) Prior Publication Data

US 2015/0108252 A1 Apr. 23, 2015

(30) Foreign Application Priority Data

Apr. 2, 2012 (JP) ..... 2012-083685

(51) Int. Cl.
*C11D 11/00* (2006.01)
*C11D 7/24* (2006.01)
(Continued)

(52) U.S. Cl.
CPC ..... *C11D 11/0041* (2013.01); *B65D 83/682* (2013.01); *B65D 83/752* (2013.01);
(Continued)

(58) Field of Classification Search
CPC .... C11D 11/0041; F02B 77/04; F02M 65/007
See application file for complete search history.

(56) References Cited

U.S. PATENT DOCUMENTS 5,407,453 A * 4/1995 Pierce-Ruhland ... C11D 3/2079 44/302
5,826,602 A * 10/1998 Chen ..... F02B 77/04 123/198 A (Continued)

FOREIGN PATENT DOCUMENTS

CN 2549186 Y 5/2003
DE 102010039696 A1 3/2012

(Continued)

OTHER PUBLICATIONS

International Search Report dated Feb. 12, 2013, which issued during prosecution of International Application No. PCT/JP2012/079042, which corresponds to the present application.

(Continued)

*Primary Examiner* — Gregory Webb
(74) *Attorney, Agent, or Firm* — Troutman Sanders LLP

(57) ABSTRACT

The cleaning agent for a diesel engine includes a mixed solution obtained by blending a solvent that exhibits solubility and has an ignition point of 238° C. or more, and lubricating oil such as mineral oil in a predetermined ratio. The solvent and the grease are selected such that the cleaning agent has a higher ignition temperature characteristic than the ignition characteristic of light oil, and an evaporation characteristic that takes eight minutes or more to vaporize 2.5 cc of the cleaning agent in a heated state at 120° C.

19 Claims, 15 Drawing Sheets

(51) Int. Cl.

| | |
|---|---|
| ***F02B 77/04*** | (2006.01) |
| ***C11D 7/26*** | (2006.01) |
| ***C11D 7/50*** | (2006.01) |
| ***B65D 83/68*** | (2006.01) |
| ***B65D 83/14*** | (2006.01) |
| ***C11D 7/40*** | (2006.01) |
| ***C10L 10/06*** | (2006.01) |

(52) U.S. Cl.

CPC ..... *C10L 10/06* (2013.01); *C11D 7/24* (2013.01); *C11D 7/263* (2013.01); *C11D 7/40* (2013.01); *C11D 7/5004* (2013.01); *C11D 7/5022* (2013.01); *F02B 77/04* (2013.01)

(56) References Cited

U.S. PATENT DOCUMENTS

| | | | | |
|---|---|---|---|---|
| 5,955,410 | A * | 9/1999 | Dingess | C11D 3/18 134/2 |
| 6,130,191 | A | 10/2000 | Ribelin et al. | |
| 6,357,674 | B1 | 3/2002 | Nakashima | |
| 7,135,447 | B1 * | 11/2006 | Bowsman | C10L 1/143 510/185 |
| 7,927,387 | B1 * | 4/2011 | DiFilippo | C10L 1/14 44/389 |
| 8,951,951 | B2 * | 2/2015 | Zaki | C11D 1/526 510/101 |
| 2002/0116782 | A1 * | 8/2002 | Bowsman | C10L 1/143 15/302 |
| 2008/0149141 | A1 * | 6/2008 | Sales | F01D 25/002 134/22.1 |
| 2010/0093579 | A1 | 4/2010 | Boyde et al. | |
| 2013/0220379 | A1 | 8/2013 | Sprugel et al. | |

FOREIGN PATENT DOCUMENTS

| | | | |
|---|---|---|---|
| EP | 1306136 | A1 | 5/2003 |
| EP | 1813403 | A1 | 8/2007 |
| JP | S49-110704 | | 10/1974 |
| JP | S60-155299 | | 8/1985 |
| JP | S61237946 | A | 10/1986 |
| JP | S61-268798 | | 11/1986 |
| JP | H06-313198 | | 11/1994 |
| JP | H06-322393 | | 11/1994 |
| JP | H08-189381 | | 7/1996 |
| JP | H10-001698 | | 1/1998 |
| JP | H10-001699 | | 1/1998 |
| JP | 2000-213367 | | 8/2000 |
| JP | 2002-129198 | | 5/2002 |
| JP | 2002-221042 | | 8/2002 |
| JP | 2010-520319 | | 6/2010 |
| WO | 00/18743 | A1 | 4/2000 |
| WO | 2008/104745 | | 9/2008 |

OTHER PUBLICATIONS

Partial European Search Report dated Jan. 4, 2016 issued in corresponding European Patent Application No. 12873784.8.

Extended European Search Report issued on Jun. 6, 2016 for the corresponding European Patent Application No. 12873784.8.

Lindsay Smith, et al., "The Autoxidation of Simple Esters: Towards an Understanding of the Chemistry of Degradation of Polyol Esters Used as Lubricants", Journal of the Japan Petroleum Institute, Jul. 2002.

* cited by examiner

| | SPRAY NOZZLE DRILLING CONDITION | EXPERIMENT RESULT |
|---|---|---|
| A | ONE HOLE ONLY AT CENTER |  |
| B | FOUR HOLES FOUR ON SIDE WITH INCLINATION ANGLE |  |
| C | FIVE HOLES FOUR ON SIDE AND ONE AT CENTER WITH INCLINATION ANGLE |  |
| D | FOUR HOLES FOUR ON SIDE WITHOUT INCLINATION ANGLE (RIGHT ANGLE 90 DEGREES) |  |

INTERNAL CLEANING AGENT FOR DIESEL ENGINE AND CLEANING SYSTEM USING THE SAME

CROSS REFERENCE TO RELATED APPLICATIONS

This application is a U.S. National Phase Application under 35 U.S.C. §371 of International Patent Application No. PCT/JP2012/079042 filed Nov. 8, 2012 which claims priority to Japanese Patent Application No. 2012-083685 filed Apr. 2, 2012. The International Application was published on Oct. 10, 2013, as International Publication No. WO 2013/150678 under PCT Article 21(2). The entire contents of these applications are hereby incorporated by reference.

TECHNICAL FIELD

The present invention relates to internal cleaning agents for engines. Specifically, the present invention relates to a cleaning agent that can be sprayed from an intake system with the diesel engine running to clean and remove carbon and sludge deposits on the inside of the engine, the cleaning agent including a mixture of solvent and grease selected under predetermined conditions and serving as a diesel engine internal cleaning agent, which does not self-ignite in the compression stroke, but burns with the removed dirt after exhibiting its cleaning effect. The present invention also relates to an internal cleaning system for a diesel engine using the cleaning agent.

BACKGROUND ART

In Japan, exhaust emission regulations for diesel vehicles have been tightened since 1993, in view of the environmental destruction by toxic substances emitted from diesel engines. In other words, a short-term regulation, a long-term regulation, and a new short-term regulation have been introduced. Furthermore, a new long-term regulation to be the most stringent emission standard in the world was introduced in 2005. Furthermore, the "Automotive NOx and PM Law" and the like are in operation in specified areas. In this manner, Japan has tackled the reduction of black smoke such as nitrogen oxides (NOx) and particulate matter (PM: Particulate matter). However, vehicles before the regulation and vehicles with a long travel distance and a long use period are being used. Hence, diesel engine automobiles that emit a large amount of black smoke are still in use. It becomes a problem with the vehicles before the regulation and the vehicles with a long travel distance and a long use period that the emissions of black smoke, that is, particulate matter due to incomplete fuel combustion, have an adverse effect on the environment rather than nitrogen oxides. Also in the vehicle inspection standard, the emission amount of black smoke is the item to be checked strictly. Furthermore, the particulate matter emission standard one stage before the latest emission standard for new vehicles is defined for diesel trucks and buses in the one metropolis and three prefectures including Tokyo, Chiba, Saitama, and Kanagawa from Oct. 1, 2003. The passage operation of vehicles that do not meet the standard is banned in the areas.

In a combustion system for a diesel engine, fuel is injected into the heated compressed air to burn the spontaneously ignited fuel. On the other hand, in a combustion system for a gasoline engine, an air-fuel mixture of air and gasoline is compressed and ignited, and burns. The two combustion systems are greatly different. NOx in the exhaust gas of the diesel engine is generated under high temperature conditions of complete fuel combustion. Meanwhile, particulate matter (PM), mainly black smoke, is generated under incomplete fuel combustion. It is not easy to take a measure against the generation of black smoke and NOx in the exhaust gas of the diesel engine in the trade-off relationship.

Therefore, new vehicles meet the exhaust emission standard due to the regulation effects at the outset. However, there are few regulations after the registration and before the renewal inspection. Goods vehicles and the like are put under heavy load when gathering speed with a full load. Moreover, black smoke (PM) in the exhaust gas emitted during the drive where start and stop are repeated increases proportional to a travel distance under the present conditions. A black smoke measurement device or opacimeter is used to measure exhaust gas in the vehicle renewal inspection. The most important issue is the emission of black smoke (PM) in the practice of the inspection.

In order to solve such a problem, new technologies have also been developed. Specifically, fuel is injected a plurality of times by a common rail system that injects fuel at high pressures, and electronic control, so that complete combustion is promoted. Particulate matter (PM) is filtered using a particulate matter removing device (DPF: diesel particulate filter). The particulate matter is burned to form $CO_2$. Furthermore, a urea injection system (SCR selective catalytic reduction) is used to convert harmful NOx into harmless nitrogen and water. Consequently, the gas emitted from the engine is harmless $CO_2$, nitrogen, and water. In order to reduce them simultaneously, an ultra high pressure common rail fuel injection system, a urea SCR (selective catalytic reduction) system, a particulate matter removing device, and the like are mounted. Consequently, the above simultaneous reduction is achieved. The latest diesel engine can meet the NOx and PM emission standard during a period while the new-vehicle state can be kept. However, there is a problem that the vehicles with a long use period and a long travel distance and the vehicles before the regulation may not meet the standard at the time of the vehicle renewal inspection.

Effective means for reducing black smoke and the like that are emitted from existing diesel vehicles no matter how small a degree is to use the engine with a clean inside by keeping the new-vehicle state as much as possible, or to create an environment in which complete combustion can be achieved by cleanly removing carbon and sludge deposits and the like on the intake and exhaust systems and the combustion chamber. In the gasoline engine, a cleaning agent such as a solvent can be mixed in an air/fuel mixture with the engine running Hence, it is relatively easy to clean the inside without dismantling the engine. Hence, various commercial cleaning agents for the gasoline engine are available. However, the diesel engine has difficulty performing a practice similar to that performed by the gasoline engine. In other words, the diesel engine does not have an ignition system, and accordingly causes fuel to be spontaneously ignited by compression heat, and burns the fuel. Hence, a combustible material taken into the cylinder in the intake stroke with the engine running, the combustible material having a lower ignition temperature than that of diesel fuel such as light oil, is self-ignited in the compression stroke. Hence, what is called diesel knock occurs, and accordingly the engine is broken. For this phenomenon, a method for diluting the concentration of an internal cleaning agent for a diesel engine to approximately 1% is conventionally taken when the cleaning agent is mixed with the fuel for use.

However, strongly adhering or deposited carbon and sludge cannot be removed completely with such a conventional fuel mixing type cleaning agent. For example, cleaning work may be performed using a fuel mixing type cleaning agent having a high cleaning effect due to a chemical action. This cleaning agent contains a surfactant mainly including alkyl amine oxide, an inorganic alkali agent, an amine solvent, a glycol ether solvent, and the like. Hence, there is a problem of the aftertreatment of the used strong alkali agent. Moreover, the evaporation of acetone or thinners during work also has an adverse effect on the natural environment and the health of the worker. Hence, it is desired to avoid their use. Furthermore, if the engine is dismantled for the work, the amount of use of the strong alkali agent and acetone or thinners is several liters. On the other hand, in the method of spraying inside the engine, the required amount of use is several hundred milliliters. Therefore, the use of an approximately 10-times amount is required in the case of overhauling. Hence, the influence on the natural environment is further increased. In any case, if a diesel engine mounted vehicle finds its state as bad as that it cannot pass the renewal inspection, for example, the following means is taken. Chemical cleaning is performed in which a surfactant and a solvent of amine or the like are attached and penetrated to the dismantled engine for dissolution. If hard carbon that is out of control in the chemical cleaning deposits, means for applying physical stress such as polishing work and separating the hard carbon, or replacement with a new part or rebuilt engine is performed. They have a problem that it takes trouble, time, and costs.

In view of the above circumstances, various technologies have conventionally been proposed. Proposed is, for example, "in a cleaning method where a cleaning agent is injected into an intake manifold of an automobile diesel engine to clean an intake system and a combustion chamber, a method for cleaning the intake system and the combustion chamber of an automobile engine is provided, where an air duct provided between an intake manifold and an air cleaner is removed from the intake manifold, and the cleaning agent is injected toward the inside of the intake manifold in a fine mist form with such a spread as to spread evenly inside the intake manifold when the engine is running" (see Patent Document 1).

The above technology relates to the following technology. In other words, as means for avoiding diesel knock, a nozzle, called mechanical brake-up tip, that makes the cleaning solution finer is provided to a distal end of a tubular-shaped nozzle, liquid particles in an atomized state are made finer, and the amount of the cleaning solution is reduced. Accordingly, diesel knock and water hammer are avoided. The above technology, similar to the invention of the present application, cleans the intake system to the inside of the combustion chamber without dismantling and cleaning the diesel engine when the engine is running.

However, according to such a technology, it is required to reduce the injection amount of the cleaning agent. Therefore, an effective cleaning effect cannot be obtained. Hence, it is not suitable to remove strongly deposited carbon. Moreover, in the technology, there is neither description nor suggestion to specify the composition of the cleaning agent. Hence, conversely, the atomization of fine particles makes it easy to cause abnormal combustion being early self-ignition in the compression stroke, depending on the kind of cleaning solution. Moreover, in Patent Document 1, the injection time is 96 ml, 6.5-7.5 ml/10 sec, 2 minutes 28 seconds to 2 minutes 8 seconds. Therefore, this is different from a method of the invention of the present application that gradually removes accumulated carbon and combustion waste over 20 to 30 minutes, using the penetration ability of the cleaning agent and the intake pulse and combustion pressure by the operation of the engine.

Moreover, an "aerosol product for cleaning a diesel engine intake system and a cleaning method using the same, which can clean the intake system excellently without dismantling a diesel engine, and also reduces an abnormal high rotation speed of the diesel engine and knocking" is also proposed (see Patent Document 2).

In such a technology, a main technology to avoid knocking is a cleaning agent injection amount per unit time as described in claim 1 according to Patent Document 2. An injection amount in a common range to an injection amount recommended by the invention of the present application is described therein. In Patent Document 2, there is a description of 6-3 g/10 sec, but an absolute injection amount is not described. The amount of a cleaning agent according to the difference of engine displacement is not written. Patent Document 2 and the invention of the present application are very different in the following points. In other words, the invention of the present application requires an approximately half injection amount of 5-20 g/min (0.83-3.3 g/10 sec) compared with the invention of Patent Document 2. Furthermore, evaporation time is taken into account in the case of the cleaning agent of the invention of the present application. Moreover, Patent Document 2 also describes that the characteristics of an aromatic solvent, such as a flash point, are taken into account to avoid knocking.

Furthermore, the injection amount of the present application is 0.5-1.0 g per 1 $cm^2$ of the area of the combustion chamber for 20 to 30 minutes. A description of such an amount of the cleaning agent according to the area of dirt is not found, either.

However, the aromatic solvent concretely specified in the above technology has a lower flash point than that of light oil. Hence, as can be seen from the embodiments described in Patent Document 2, knocking is more likely to occur. Hence, the absolute amount of the solvent cannot be increased. Moreover, many of aromatic solvents are more likely to evaporate under high temperature conditions. Hence, the solvents evaporate and burn off before penetrating gaps between carbon deposit layers. Hence, strongly deposited carbon layers cannot be separated. Hence, the above technology cannot use the physical action of a flame shock as in the invention of the present application.

Furthermore, a technology of "a cleaning agent composition which is suitable for an oil fouling removal process by exerting excellent oil fouling cleaning performance without having an adverse effect on a base material, and the like, and further suitably used for cleaning an engine compartment, cleaning tools and parts, and cleaning a floor" is also proposed (see Patent Document 3).

In the above technology, a surfactant with alkyl amine oxide as the main component, and an inorganic alkali agent are contained. Alternatively, alkyl amine oxide, an inorganic alkali agent, and an amine solvent and/or glycol ether solvent are contained. Therefore, a cleaning effect by the chemical action is estimated to be high. However, the surfactant is the main component, and accordingly, the environmental load is heavy. Moreover, the technology is conceived on the precondition that the engine is dismantled and cleaned. Hence, it is considered that the technology cannot be used when the engine is running. Moreover, it is desired to avoid aftertreatment of the strong alkali agent used for the cleaning work and evaporation of acetone or thinners during work. This point is similar to white exhaust smoke or one providing stimulation to a person that is emitted in the conventional method that injects a cleaning agent into the engine for cleaning. In the case where the engine is dismantled to conduct work, the amount of use of these strong alkali agent, and acetone or thinners is several liters. On the other hand, the method in which the inside of the engine is sprayed requires the amount of use of several hundred milliliters. Therefore, the use of an approximately 10-times amount is required in the case of overhauling. Hence, the influence on the natural environment is also increased.

An acetate solvent, an amine alcohol solvent, ammonia water, ethers, esters, glycol ether, ketones, terpene alcohol, terpene hydrocarbon, a chlorine compound (halogen), a surfactant, a nitrogen compound, fatty acid, a petroleum solvent, and the like have been used as conventional solvents for the purpose of cleaning the inside of the engine. They also contain the target solvents of harmful substances whose names and the like should be notified under the Industrial Safety and Health Act, the Act on the Evaluation of Chemical Substances and Regulation of Their Manufacture, the Poisonous and Deleterious Substances Control Law, and the Act on Confirmation, etc. of Release Amounts of Specific Chemical Substances in the Environment and Promotion of Improvements to the Management Thereof (PRTR Law). The use of these solvents is desired to be avoided as much as possible.

Moreover, many of solvents used for commercial cleaning agents have IPA (isopropyl alcohol) or MEK (methyl ethyl ketone) as the main component. The cleaning effects of such solvents are worthy of evaluation. However, volatility is extremely high, and hence a problem that the health of the worker is impaired, such as causing the irritation of the eyes of the worker or causing breathing difficulty, arises if used with the engine running.

Moreover, the commercial products used with the engine running include, for example, a trade name: Throttle Valve Cleaner (product number/code: A110 TV-C) of WAKO Chemical, Ltd. However, as described in the precautions for use, diesel knock occurs if used for the diesel engine. For this reason, it is instructed not to use the product when the engine is running and to be sure to stop the engine and clean with a brush. Moreover, the company also has a system, a trade name: "RECS (rex)," that injects a cleaning agent during the operation of the engine (configured by the cleaning agent and a syringe using engine vacuum). However, this system emits a large amount of white exhaust gas during and after the injection of the cleaning agent. Moreover, the system cannot be used for the diesel engine.

The inventor of the present application has performed overhauling work for the purpose of repair and output improvement on race engines and commercial engines, and the like over the long period. In these experiences, the inventor also handled many engines that had been used without replacing oil for a period twice or more as long as a normal oil replacement period, and engines of vehicles that had traveled with an oil amount less than specified. What the inventor noticed through such experiences gives a clue to the present invention. In other words, a considerable amount of carbon and sludge may be attached in the vicinity of the center of the top of the piston in an engine under severe conditions or an engine whose lubrication condition has grossly deteriorated. Even in such a case, it is confirmed in many cases that carbon and sludge were removed from the vicinity of the top of the piston and an area called piston round, and the metal surface of the piston was exposed. In other words, attention is given to a point that the lubricating oil that have entered the combustion chamber in an oil rising phenomenon due to the wear of the piston, cylinder, and piston ring also has a high cleaning effect. In addition, an inspiration is formed in which the forces of pulsations and combustion waves that are generated by the engine are also more effectively used, and accordingly the inside of the engine can be cleaned more efficiently without emitting toxic substances. Experiments were performed from many different angles for blending conditions of a solvent and grease that do not cause diesel knock, and the like, and combustion state, evaporation time, and the like of a cleaning agent. As a consequence, a cleaning agent according to the present invention that can also clean a diesel engine with the engine running, similarly to the cleaning of a gasoline engine, has been developed. Various experiments were repeated on a point that which system makes the use of the cleaning agent most effective to enhance the effect of the cleaning agent. As a consequence, a cleaning system according to the present invention has been completed.

CITATION LIST

Patent Literatures

Patent Document 1: JP-A-2000-213367
Patent Document 2: JP-A-2002-129198
Patent Document 3: JP-A-2010-520319

SUMMARY OF THE INVENTION

Problems to be Solved by the Invention

The present invention intends to provide the following cleaning agent considering the above problems. The cleaning agent does not cause knocking even if taken into the combustion chamber when the diesel engine is running. Furthermore, the cleaning agent exhibits a high cleaning effect, and has a long-lasting cleaning effect. Furthermore, the present invention also aims to provide a technology related to a diesel engine internal cleaning system using the cleaning agent.

Solutions to the Problems

The present invention relates to an internal cleaning agent for a diesel engine to be sprayed from an intake system with a diesel engine running to clean and remove carbon and sludge deposits on the inside of the engine, the cleaning agent including a mixed solution in which a solvent and a grease are blended, wherein the solvent includes at least one or more of liquid soluble substances, and properties of the solvent includes an ignition point of 238° C. or more, ability of weakening formability of carbon deposit layer by attaching to and penetrating the carbon deposit layer, and exertion of sludge-dissolving power, the grease is lubricating oil made up of any of mineral oil, chemical synthetic oil, semi-synthetic oil, vegetable oil, or a combination thereof, and has a property as engine oil to be used to improve adhesion and a deposition time of the solvent, the mixed solution is formed by blending the grease and the solvent, and the grease and the solvent are selected in such a manner that the mixed solution has the following properties as well as evaporation characteristics:

the properties include igniting at a higher temperature than the ignition characteristic of light oil, and preventing a knocking phenomenon before a fuel injection timing and at the end of the compression stroke from a relationship between the ignition timing and a flame propagation speed, and the evaporation characteristics include an evaporation time of eight minutes or more for vaporizing 2.5 cc of the mixed solution in a heated state at 120° C., and a blending ratio of solvent to grease is within a range of 99:1 to 80:20 in weight ratio.

The present invention may also relate to the internal cleaning agent for a diesel engine according to a first aspect, wherein the solvent is selected in such a manner that the mixed solution has the ignition characteristic and the evaporation characteristic, and the ignition temperature of the mixed solution has an ignition characteristic within a range that does not exceed 480° C.

The present invention may also relate to the internal cleaning agent for a diesel engine according to a first or second aspect, wherein the solvent is ethylene glycol monobutyl ether (chemical name) (trade name: EGBE or Butyl CELLOSOLVE) "CAS Registry Number 111-76-2," and a blending ratio of the solvent to the grease is within a range of 95:5 to 80:20 in the weight ratio.

The present invention may also relate to the internal cleaning agent for a diesel engine according to the first or second aspect, wherein the solvent is ethylene glycol monotertiary butyl ether (chemical name) (trade name: Swasolve ETB) "CAS Registry Number 7580-85-0," and a blending ratio of the solvent to the grease is within a range of 99:1 to 80:20 in the weight ratio.

The present invention may also relate to the internal cleaning agent for a diesel engine according to the first or second aspect, wherein the solvent is Vege-sol (chemical name) (trade name: Vege-sol made by Kaneda Co., Ltd. is a registered trademark) with vegetable oil (soybean fatty acid ester) as the main component, "CAS Registry Number 67784-80-9," and a blending ratio of the solvent to the grease is within a range of 99:1 to 80:20 in the weight ratio.

The present invention may also relate to the internal cleaning agent for a diesel engine according to any of first to fifth aspects, wherein the grease is paraffin oil.

The present invention may also relate to the internal cleaning agent for a diesel engine according to any of the first to fifth aspects, wherein the grease is naphthenic oil.

The present invention may also relate to the internal cleaning agent for a diesel engine according to any of the first to fifth aspects, wherein the grease is poly-α-olefin (PAO: poly-α-olefin).

The present invention may also relate to the internal cleaning agent for a diesel engine according to any of the first to fifth aspects, wherein the grease is Kurisef oil F (trade name (Kurisef oil is a registered trademark)) (viscosity grade range of 8 to 46) of naphthenic raw oil.

The present invention may also relate to the internal cleaning agent for a diesel engine according to the first or second aspect, wherein the solvent is a solvent obtained by mixing ethylene glycol monobutyl ether (chemical name) (trade name: EGBE or Butyl CELLOSOLVE) "CAS Registry Number 111-76-2" and Vege-sol (trade name: Vege-sol made by Kaneda Co., Ltd. is a registered trademark) with vegetable oil (soybean fatty acid ester) as the main component, "CAS Registry Number 67784-80-9,"

the grease is poly-α-olefin (PAO: poly-α-olefin), and a blending ratio of the solvent to the oil, which is mixed, is within a range of 95:5 to 80:20 in the weight ratio.

The present invention may also relate to an internal cleaning system for a diesel engine for effectively exerting a cleaning effect of the internal cleaning agent for a diesel engine, the system including:

an aerosol can filled with the internal cleaning agent for a diesel engine according to any of first to tenth aspects; and a spray-nozzle-equipped hose, wherein the aerosol can includes an injection state fixing device for maintaining an injection state, the nozzle-equipped hose has an outer diameter within a range of 2.5 mm to 4.0 mm, and an inner diameter within a range of 1.2 mm to 2.5 mm, and has an oil resistant property and flexibility, a distal end of the hose on a spray side is sealed, and the nozzle-equipped hose includes a plurality of spray nozzles (diameter: 0.1 mm to 0.3 mm) at positions dividing an internal circumference evenly, in a side portion within a range of 5 to 30 mm from the sealed distal end to diffuse the internal cleaning agent for a diesel engine into a combustion chamber in an atomized state, and the spray nozzle is provided in such a drilled manner as to incline divergently at an angle within a range between 90 degrees orthogonal to a longitudinal direction of the hose and 45 degrees with respect to a direction toward the combustion chamber.

The present invention may also relate to the diesel engine internal cleaning system according to an eleventh aspect, wherein a spray nozzle (diameter: 0.1 mm to 0.3 mm) is also provided to a center portion on an end surface of the distal end portion of the nozzle-equipped hose.

The present invention may also relate to the internal cleaning system for a diesel engine according to an eleventh or twelfth aspect, wherein a venturi portion is provided in the middle between the spray nozzles provided to the side portion of the spray-nozzle-equipped hose and the aerosol can.

The present invention may also relate to the diesel engine internal cleaning removal system according to any of eleventh to thirteenth aspects, wherein the internal cleaning agent for a diesel engine according to any of the first to tenth aspects is intermittently injected by providing an intermittent injection control device 50.

The present invention may also relate to the diesel engine internal cleaning removal system according to any of eleventh to fourteenth aspects, wherein two or more aerosol cans are provided, the solvent and the grease to constitute the internal cleaning agent for a diesel engine according to any of the first to tenth aspects are respectively and separately filled in the two or more aerosol cans, an end of a hose for installing nozzles is connected to a spray nozzle of each of the plurality of aerosol cans, and the other end of the hose for installing nozzles is connected to a mixed solution blending portion, the mixed solution blending portion integrates the plurality of hoses for installing nozzles, and controls over blending by controlling a solenoid valve in such a manner as to constitute the mixed solution according to any of the first to tenth aspects, and the blending portion is connected to a rear end portion of the nozzle-equipped hose. In the present document, that "the solvent and the grease that constitute the diesel engine internal cleaning agent according to any one of the first to tenth aspects are respectively and separately filled" does not mean, for example, that the two of the solvent and the grease are simply separated into the two aerosol cans. This means to become the cleaning agent according to any one of the first to tenth aspects in the end, such as a combination of two or more kinds of mixed solutions, a combination of a mixed solvent and a mixed grease, a combination of grease and a mixed solution, or a combination of a solvent and a mixed solution.

The present invention may also relate to the internal cleaning system for a diesel engine according to a fifteenth aspect, wherein a plurality of electromagnetic pump type injection devices is provided instead of the aerosol cans, the electromagnetic pump type injection device injects the solvent and the grease constituting the internal cleaning agent for a diesel engine according to any of the first to tenth aspects, respectively and separately, to the mixed solution blending portion, and the internal cleaning agent for a diesel engine is diffused into the combustion chamber in an atomized state via the spray-nozzle-equipped hose connected to the mixed solution blending portion.

The present invention may also relate to the internal cleaning system for a diesel engine according to the fifteenth aspect, wherein a plurality of pressurized air type injection devices is provided instead of the aerosol cans, a plurality of pressure containers provided in the pressurized air type injection device respectively and separately accommodate the solvent and the grease that are required to form the internal cleaning agent for a diesel engine according to any of the first to tenth aspects, the pressure container is pressurized by pressurized air supplied from an air compressor to inject the solvent and the grease to the mixed solution blending portion via the respective separation hoses, and the internal cleaning agent for a diesel engine is diffused into the combustion chamber in an atomized state via the spray-nozzle-equipped hose connected to the mixed solution blending portion.

The present invention may also relate to the internal cleaning system for a diesel engine according to sixteenth or seventeenth aspect, wherein a gas introduction hole for introducing a part of gas in the container accommodating the solvent and the grease is provided at a position above a liquid surface on a conduit inserted through to a bottom of the container, a liquid layer of the solvent and the grease and a gas layer taken in from the gas in the container, which flow through the spray-nozzle-equipped hose, are alternately created, and the flow passes through the venturi portion and accordingly the gas is mixed in the internal cleaning agent for a diesel engine according to any of the first to tenth aspects to facilitate atomization.

In the present document, ethylene glycol monobutyl ether (chemical name) (trade name: EGBE or Butyl CELLOSOLVE) "CAS Registry Number 111-76-2" is hereinafter simply referred to as "EGBE." Ethylene glycol monotertiary butyl ether (chemical name) (trade name: Swasolve ETB) "CAS Registry Number 7580-85-0" is hereinafter simply referred to as "ETB." Vege-sol (trade name: Vege-sol made by Kaneda Company Ltd. is a registered trademark) with vegetable oil (soybean fatty acid ester) as the main component, "CAS Registry Number 67784-80-9" is hereinafter simply referred to as "Vege-sol." Among grease, a poly-α-olefin (PAO: poly-α-olefin) is hereinafter simply referred to as "PAO." Kurisef oil of naphthenic raw oil (trade name (Kurisef oil is a registered trademark)) (viscosity grade range of 8 to 46) is hereinafter simply referred to as "Kurisef oil."

Effects of the Invention

A cleaning agent and a system according to the present invention exhibit the following excellent effects. That is, even if the cleaning agent and the system according to the present invention are used when the diesel engine is running, knocking does not occur. Furthermore, the cleaning agent and the system according to the present invention can effectively clean and remove carbon and sludge deposits on the inside of the engine such as the intake and exhaust systems and the inside of the combustion chamber. Furthermore, the cleaning agent and the system according to the present invention can reduce the emission of PM and black smoke, and improve fuel efficiency.

Moreover, the cleaning agent and the system according to the present invention can eliminate the need of the conventional dismantlement and cleaning Therefore, an excellent effect that can promote reductions in working labor, working time, and costs is exhibited.

Moreover, the cleaning agent and the system according to the present invention exhibit the following excellent effects. In other words, grease is contained, and accordingly, a covering effect of the grease suppresses the evaporation of a solvent. Hence, the adhesion of the solvent is improved. Furthermore, the solvent increases penetrability. As a consequence, in addition to the cleaning effect of the solvent, a cleaning effect intrinsic to the grease is also exhibited.

Moreover, the cleaning agent and the system according to the present invention exhibit the following excellent effects that are not included in the conventional technologies. In other words, the evaporation time is long, and accordingly, penetration is held in gaps between strongly deposited carbon layers for a long time. With the penetration holding power, the bonding power of hard carbon and sludge deposits, and the like in the engine is weakened, and they are changed to soft carbon and sludge. Furthermore, in addition to the chemical cleaning effect, the intake pulse of the engine and a flame shock by combustion work, so that carbon and the like can be physically destroyed or separated to be removed.

Moreover, according to the cleaning agent and the system according to the present invention, the cleaning agent according to the present invention is atomized in the intake stroke and attaches to an inner wall of an intake tube, a cylinder head, an inner wall of a cylinder, a valve mechanism, and the like. The cleaning agent attached to the cylinder inner wall and the like enters a ring groove of the piston in the compression stroke. In this manner, the cleaning agent penetrates the carbon and sludge attached to the ring groove, the piston ring, and the like. Furthermore, the volume of the combustion chamber is reduced as the compression stroke continues. Hence, the cleaning agent attaches to and penetrates the piston head in a colliding state due to a difference in weight between air and the cleaning agent. A similar state to this phenomenon can be seen in lubricating oil mixed with gasoline in a two-cycle engine. In the two-cycle engine, a mixture of gasoline and lubricating oil suctioned into a crankcase is sent to the high-temperature combustion chamber in the exhaust stroke. The gasoline fuel evaporates, ignites, and burns. However, even after the gasoline evaporates, the lubricating oil keeps attaching to the inner wall of the cylinder and the combustion chamber to reach the piston ring and the ring groove. Consequently, a lubrication effect is exhibited. The lubricating oil subsequently evaporates, and burns with the fuel. In such a two-cycle engine, if the engine is used at cool temperatures (low temperatures) and low speeds in a state where the engine temperature is low, it is well-known that white exhaust gas is emitted. The white exhaust gas is generated even if the ratio of gasoline to lubricating oil is less than 50:1. Moreover, even if the ratio of gasoline to lubricating oil is 25:1 in a high-speed heavy load state during a race, the exhaust smoke is transparent. At this point in time, white exhaust smoke is not observed. Furthermore, the attachment of carbon is not observed at the top of the piston and in the vicinity of the exhaust port, either. Furthermore, gasoline and lubricating oil in a ratio of 100:1 or 120:1 may be in practical use for an outboard motor. In other words, even 1% lubricating oil exhibits a large effect by attaching to the metal surface. Similarly to this action, most of the cleaning agent that has reached the inside of the cylinder from the injection to ignition of the diesel fuel attaches to the cylinder head, the inner wall of the cylinder, the piston ring, and the ring groove of the piston, and carbon and sludge. At this point in time, only a trace quantity of the cleaning agent remains in the heated compressed air. Hence, the suctioned cleaning agent is not burned in such a manner as to cause knocking Dirt mainly including carbon separated and removed by the penetration of the cleaning agent is burned during a period of time from the combustion stroke to the exhaust stroke, unlike carbon generated by combustion. Hence, the increase of black smoke and the generation of white smoke are not observed during the injection of the cleaning agent. The effect of reducing the amount of black smoke emissions is exhibited also in the measurement results by a black smoke measurement device and an opacimeter.

Moreover, the cleaning agent and the system according to the present invention take the following excellent effect. In other words, if a mixed solution having an ignition characteristic in a range where the ignition temperature does not exceed 480° C. is used, the emission of white smoke due to incomplete combustion can be suppressed. Hence, damage to the worker's health such as breathing difficulty or the irritation of the eyes during the cleaning work can be kept to a minimum.

Moreover, the cleaning system according to the present invention takes the following excellent effect. In other words, a plurality of minute spray holes is provided in a side portion in the vicinity of a distal end of a nozzle. Hence, the atomized cleaning agent with a small particle diameter is diffused and accordingly the cleaning agent can be distributed uniformly in the engine.

Moreover, the cleaning system according to the present invention takes the following excellent effect. In other words, if a configuration in which a venturi portion is provided at a predetermined position from a spray nozzle is adopted, the solvent and the grease are agitated again immediately before being sprayed. Hence, before the different substance separation characteristic occurs, the solvent and the grease can be caused to reach dirt such as carbon in a state where the mixing of the solvent and the grease is maintained. Hence, a strong adhesive force that the cleaning agent according to the present invention has can be exerted more effectively. It is effective especially when a solvent and grease to be combined are susceptible to separation from each other, for example, as in EGBE and PAO (see FIG. 15).

Moreover, in the case where the cleaning agent filled in an aerosol can is sent out via a long nozzle tube, a phenomenon where a gas layer of gas pressurized and filled in the aerosol can, and a liquid layer of the cleaning agent in which the gas has been dissolved pass through intermittently and alternately may happen in the tube. Such a phenomenon makes the spray state of the cleaning agent unstable, which is not ideal. However, in the case where the configuration in which the venturi portion is provided at the predetermined position of a spray-nozzle-equipped hose to be used for the internal cleaning system for a diesel engine according to the present invention is adopted in the system, the gas layer and the liquid layer are agitated by velocity and pressure changes caused when passing through the venturi portion. Hence, fine foamy gas is uniformly mixed in the cleaning agent after passage through the venturi portion. Hence, an excellent effect that the excellent atomized cleaning agent can be continuously and stably sprayed into the intake system is exhibited.

Moreover, in the case where a configuration including an intermittent spray control device is adopted in the cleaning system according to the present invention, even if the amount of the cleaning agent is the same, the cleaning work time can be prolonged. Hence, it becomes possible to effectively weaken the bonding of carbon layers strongly deposited and adhering. Moreover, an effect that prevents the occurrence of the knocking and water hammer phenomena due to a temporary large flow is also exhibited. In addition, the time during which the physical effect works, in other words, the time to apply, to dirt, shocks due to the intake pulse and combustion pressure, increases relative to the time during which the chemical effect by the cleaning agent works. Consequently, the absolute amount of the cleaning agent can be reduced. Hence, the proportion of the cleaning agent in the exhaust gas is reduced, and accordingly environmental pollution and costs can be reduced. Furthermore, there is an effect to eliminate the waste of the cleaning agent. In other words, an effect is exhibited of reducing waste that a new cleaning solution is attached to separated and removed dirt, or dirt immediately before separation and removal before the cleaning effect is fully exhibited, and accordingly the cleaning agent is discharged with the dirt before the cleaning effect is exhibited.

Moreover, the cleaning system according to the present invention may include a plurality of aerosol cans or electromagnetic pumps. Alternatively, the cleaning system may create a mixed solution of the solvent and the grease by a blending portion, and supply the created mixed solution into the engine by pressurized air type injection devices. If these systems are adopted, an excellent effect that the solvent and the grease are selected as appropriate to blend depending on the state of a vehicle and a client's request is exhibited. Moreover, even in a case of a combination that is extremely difficult to mix and is immediately separated even if agitated, for example, a combination of EGBE as the solvent and PAO as the grease (see FIG. 15), if this configuration is adopted, it becomes possible to cause the cleaning agent to penetrate the carbon layers and the like before transiting from mixture to separation.

DESCRIPTION OF EMBODIMENTS

The largest feature of the present invention is to use, as a cleaning agent, a mixed solution (13) described below. The mixed solution (13) is used to clean and remove carbon and sludge deposits and the like on the inside without knocking when a diesel engine is running. The mixed solution (13) includes a combination of a solvent (11) and grease (12). The solvent (11) and the grease (12) are selected and blended such that the mixed solution (13) has the following characteristics. In other words, the ignition temperature of the mixed solution (13) is higher than that of light oil (K). Furthermore, it takes eight minutes or more to vaporize 2.5 cc of the mixed solution (13) in a heated state at 120° C. Embodiments are hereinafter described with reference to the drawings and tables.

Figure 1:
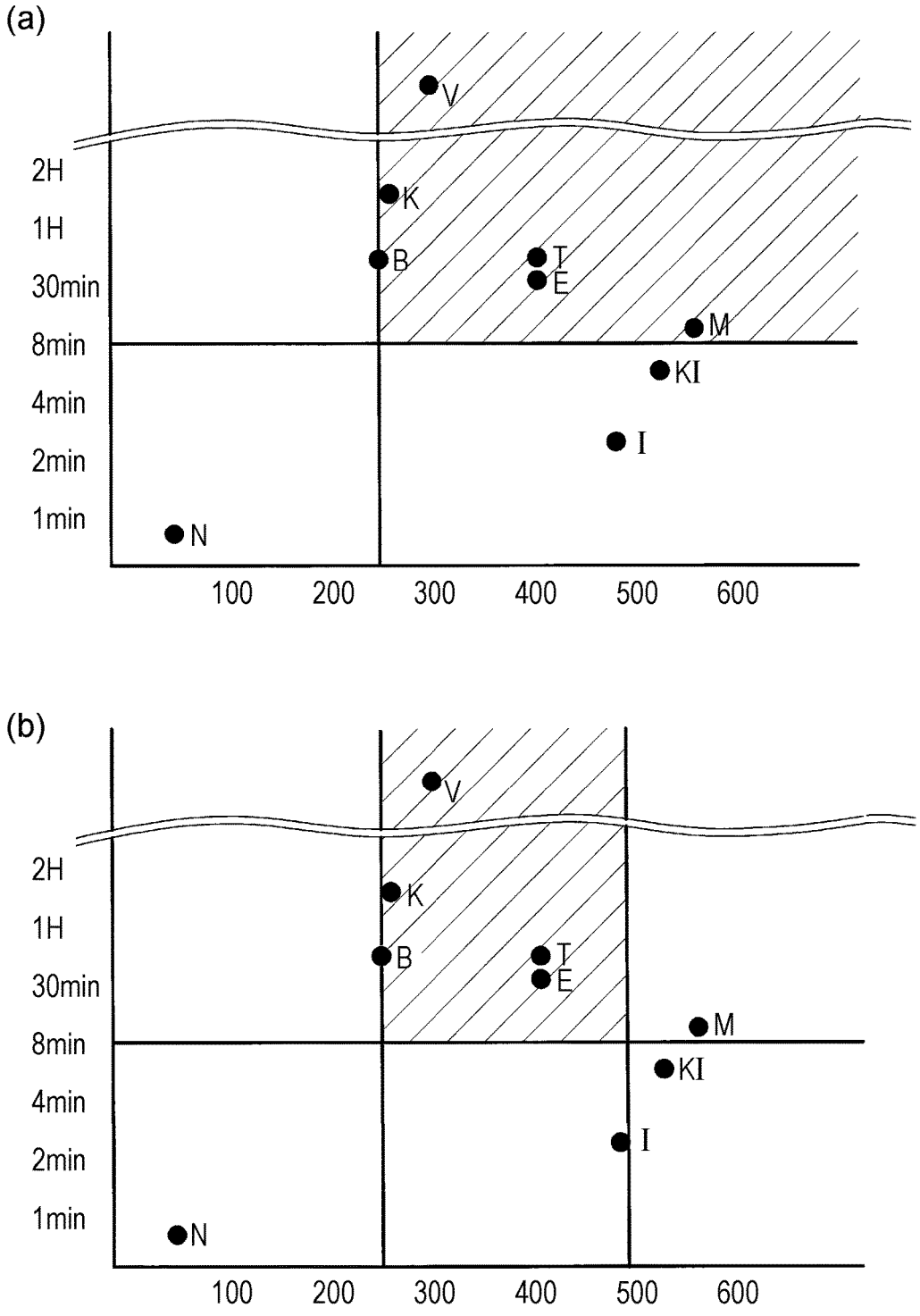
FIGS. 1A and 1B are explanatory views illustrating the ignition temperature characteristic and evaporation time characteristic of a cleaning agent according to the present invention.
Figure 2:
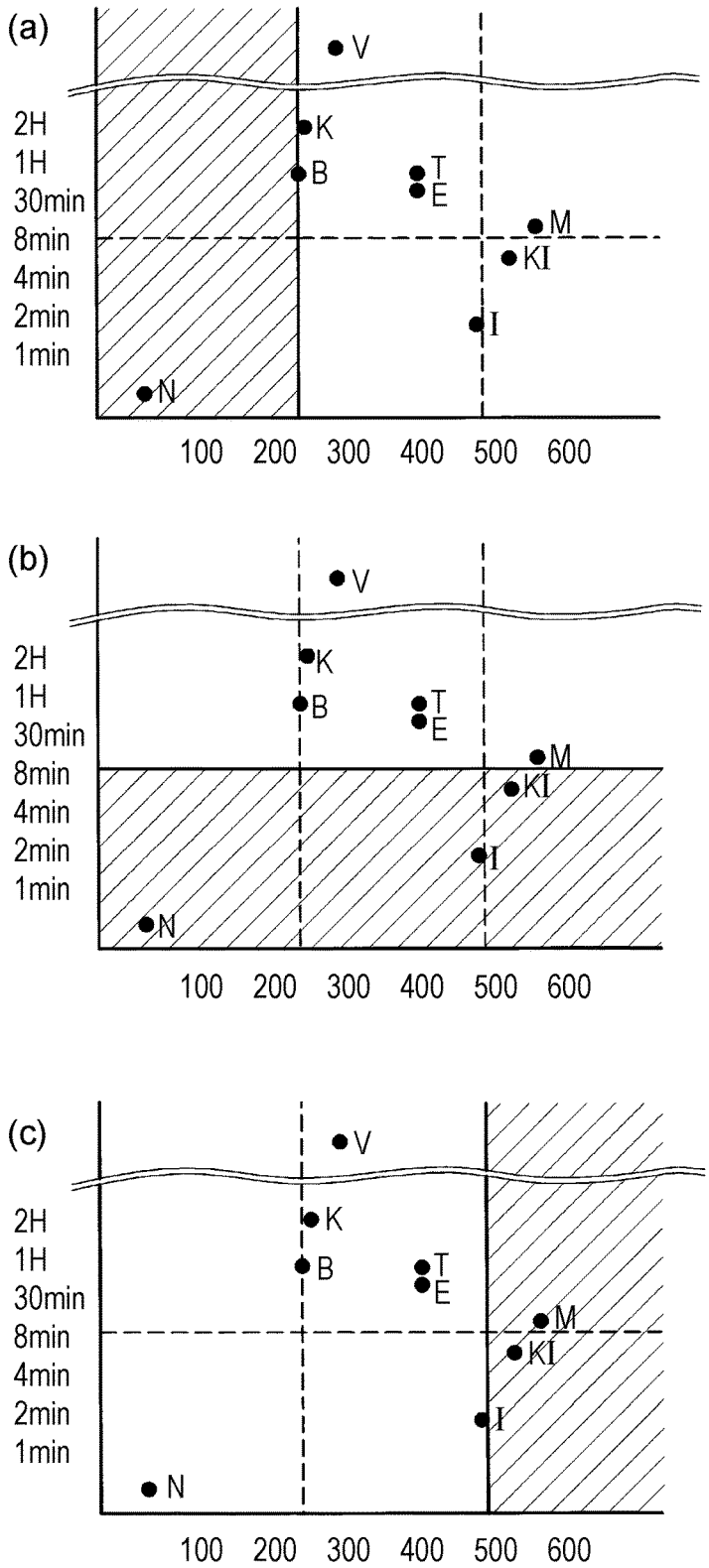
FIGS. 2A to 2C are explanatory views illustrating a characteristic region where a problem arises as the cleaning agent.

FIGS. 1A and 1B are explanatory views illustrating the ignition temperature characteristic and evaporation time characteristic of the cleaning agent according to the present invention. FIG. 1A illustrates a first aspect, and FIG. 1B illustrates a second aspect. Moreover, FIGS. 2A to 2C are explanatory views illustrating a characteristic region where a problem arises when the cleaning agent enters a cylinder with the diesel engine running FIG. 2A illustrates a region where knocking occurs. FIG. 2B illustrates a region where a high cleaning effect cannot be obtained due to a short evaporation time. FIG. 2C illustrates a region where problems such as emission of white smoke and irritation of the eyes arise since the cleaning agent resists burning. The horizontal axes of FIGS. 1A to 2C indicate the ignition temperature, and the vertical axes indicate the time required for evaporation.

The cleaning agent according to the first aspect of the present invention includes the mixed solution (13) in which the solvent (11) and the grease (12) are mixed. The solvent (11) and the grease (12) are selected and blended such that the mixed solution (13) has the following characteristics. In other words, the ignition temperature of the mixed solution (13) is higher than that of the light oil (K). Furthermore, it takes eight minutes or more to vaporize 2.5 cc of the mixed solution (13) in a heated state at 120° C. The ignition temperature is set higher than that of the light oil (K) to prevent knocking. However, knocking here does not indicate what is called ignition delay in the expansion stroke in a general diesel engine. A cleaning agent (10) according to the present invention is taken into the cylinder with air in the intake stroke. Hence, the mixed solution (13) being combustible material has a problem of early self-ignition such as knocking in the compression stroke in a gasoline engine.

Figure 3:
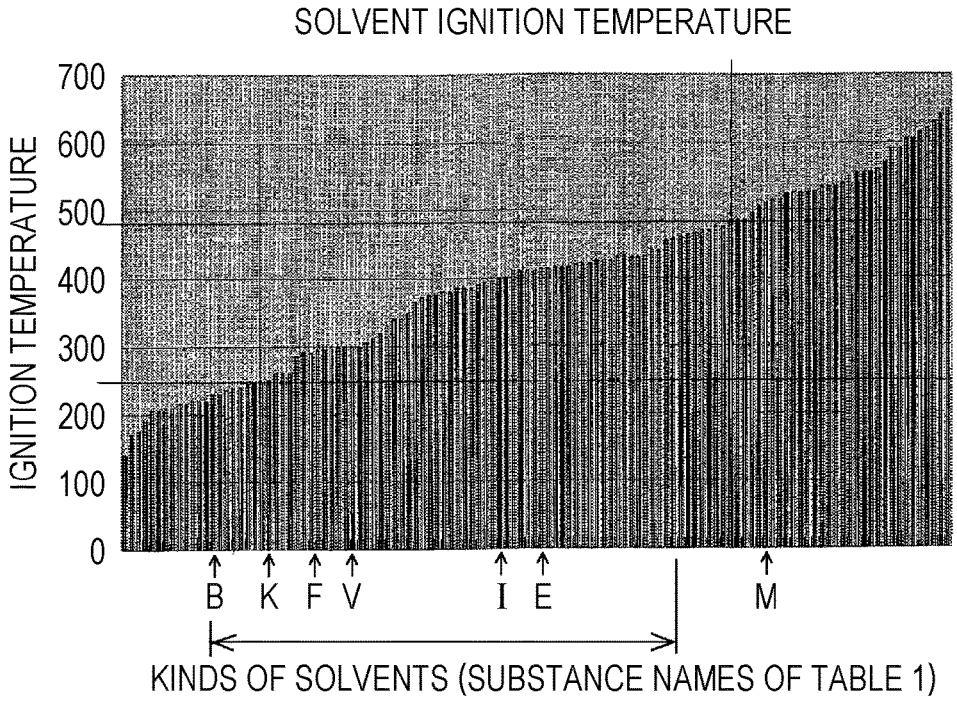
FIG. 3 is a graph of ignition temperature according to the substance having cleaning performance.
Figure 16:
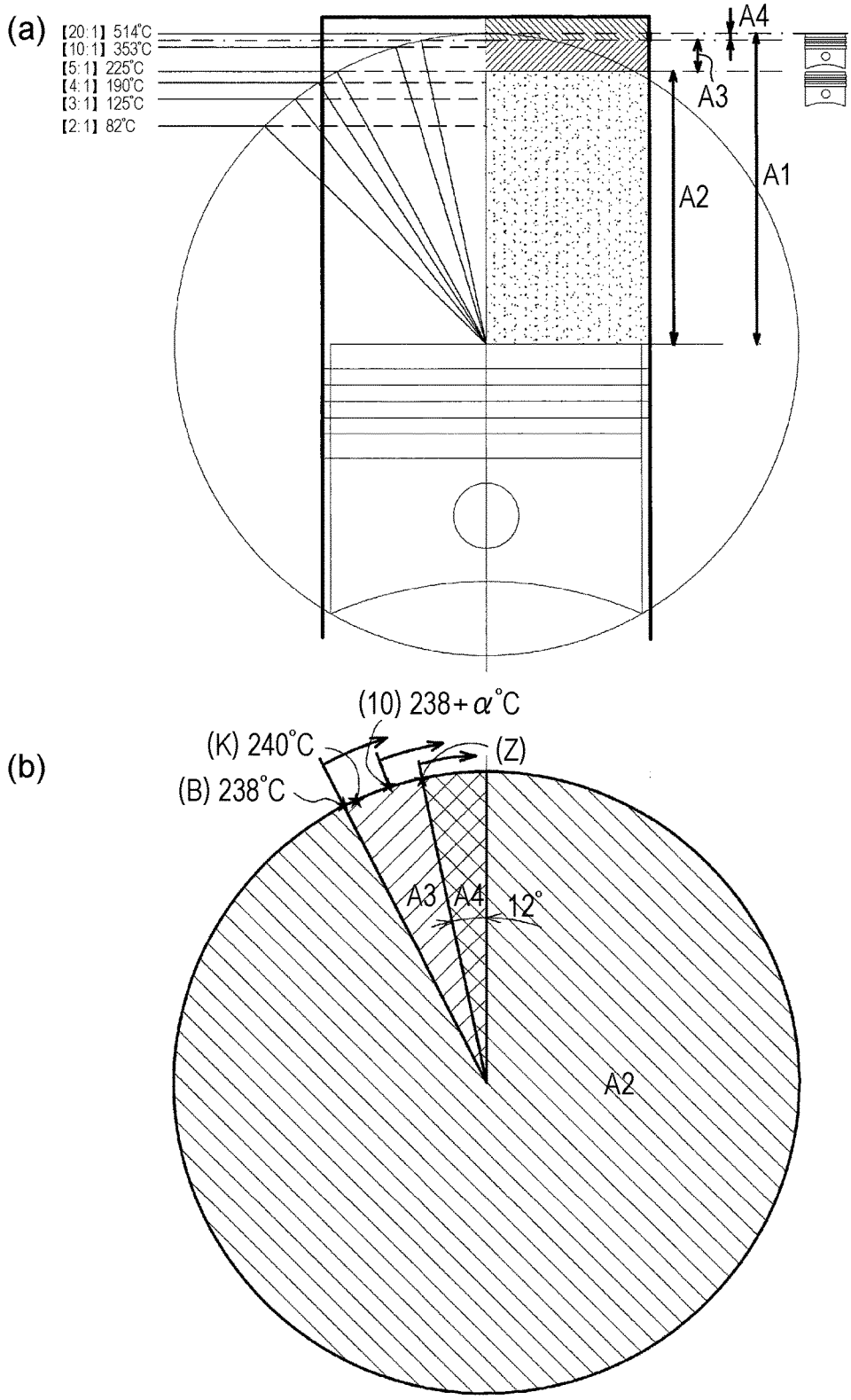
FIGS. 16A and 16B are reference drawings of changes in temperature according to the crank angle, and a knocking region.

Accordingly, the solvent (11) satisfies the following conditions. That is, the solvent (11) includes at least one or more of liquid soluble substances, and properties of the solvent includes an ignition point of 238° C. or more, ability of weakening formability of carbon deposit layer by attaching to and penetrating the carbon deposit layer, and exertion of sludge-dissolving power. The grease (12) satisfies the following conditions. That is, the grease (12) is lubricating oil made up of any of mineral oil, chemical synthetic oil, semi-synthetic oil, vegetable oil, or a combination thereof, and has a property as engine oil to be used to improve adhesion and a deposition time of the solvent (11). The mixed solution (13) of the solvent (11) and the grease (12) satisfies the following conditions. That is, the mixed solution (13) is formed by blending the grease (12) and the solvent (11), and the grease (12) and the solvent (11) are selected in such a manner that the mixed solution (13) has the following properties: the properties include igniting at a higher temperature than the ignition characteristic of light oil, and preventing a knocking phenomenon before a fuel injection timing and at the end of the compression stroke from a relationship between the ignition timing and a flame propagation speed. Specifically, the ignition point of the light oil (K), in other words, the minimum temperature to ignite without a fire source when the light oil (K) is heated in the air, is 240° C. Hence, it is considered that at least exceeding the temperature is necessary. However, the cleaning agent (10) according to the invention of the present application also contains the grease (12), mineral oil (mineral), chemical synthetic oil (synthetic), semi-synthetic oil (semi-synthetic, part synthetic, and synthetic blend), vegetable oil, and the like. Hence, it is simply required to exceed the temperature using the relationship with the ignition temperature of the grease (12). In other words, the ignition point of the solvent (11) itself is not necessarily required to exceed 240° C. For example, taking the internal cleaning agent for a diesel engine (10) according a third aspect as an example, EGBE (B) is used as the solvent (11). The ignition point of EGBE (B) is 238° C. Hence, EGBE (B) itself does not exceed the targeted ignition point of the light oil (K). Hence, EGBE (B) is required to be blended with the grease (12) having a high ignition point to obtain the ignition characteristic exceeding a hatched area in FIG. 2A. In sixth and seventh aspects, the kind of the grease (12) is specified. The ignition points of paraffin oil and naphthenic oil are both approximately 350° C. For reference purposes, the following Table 1 represents a list of substances having the ignition temperature characteristic that can configure the present invention. In the table, these substances are described in ascending order of ignition temperature. Moreover, the information from the table is graphed in FIG. 3. FIGS. 16A and 16B illustrate reference drawings of a knocking region according to changes in pressure and temperature corresponding to the crank angle.

TABLE 1

| Substance name | Minimum Ignition temperature C° | Flash point C° |
|---|---|---|
| Acetaldehyde | 140 | −38 |
| Diethyl ether | 170 | −45 |
| Dibutyl ether | 175 | 25 |
| Ethyl methyl ether | 190 | −37.2 |
| Decane | 205 | 46 |
| Nonane | 205 | 30 |
| Octane | 210 | 12 |
| Ethylcyclobutane | 210 | <−16 |
| Dipropyl ether | 215 | 21.1 |
| Heptane | 215 | −4 |
| Kerosene | 220 | 49.5 |
| Isoprene | 220 | −53.9 |
| Acrylic aldehyde | 220 | −26 |
| Tetrahydrofuran | 230 | −20 |
| Butyraldehyde | 230 | −6.7 |
| 2-Ethoxyethanol | 235 | 43 |
| Butyl CELLOSOLVE | 238 | 62 |
| Ethylcyclohexane | 238 | 35 |
| n-Hexane | 240 | −22 |
| Butyl chloride | 245 | −12 |
| Cyclohexane | 245 | −20 |
| Light oil | 250 | 71 |
| Terpene | 260 | 180 |
| Ethyl cyclopentane | 260 | <21.1 |
| Nonanol | 260 | 75 |
| Pentane | 285 | <−40 |
| 1-Hexanol | 290 | 63 |
| Cyclohexylamine | 290 | 32 |
| Ethyl acetoacetate | 295 | 57 |
| Ethanethiol | 295 | <−20 |
| Gasoline | 300 | −43 |
| Mineral oil | 300 | 80 |
| Vege-sol | 300 | 186 |
| Cyclohexanol | 300 | 68 |
| 1-Pentanol | 300 | 32.8 |
| Acetylene | 305 | Gas |
| Diethylamine | 312.2 | −23 |
| 2-Diethylaminoethanol | 320 | 60 |
| Acetic anhydride | 330 | 49 |
| Acetylacetone | 340 | 34 |
| 1-Butanol | 340 | 29 |
| Ethyl acrylate | 350 | 9 |
| Butane | 365 | Gas |
| Ethyl acrylate | 372 | 10 |
| Pentyl acetate | 375 | 25 |
| 1,4-Dioxane | 375 | 11 |
| Isopentyl acetate | 380 | 380 |
| Cyclobutane | 380 | <−7 |
| Epichlorohydrin | 385 | 28 |
| Vinyl acetate | 385 | −8 |
| Diaminoethane | 385 | 34 |
| Furan | 390 | <−20 |
| 2-Heptanone | 393 | 39 |
| Thiophene | 395 | −9 |
| IPA | 399 | 11.7 |
| Dimethylamine | 400 | Gas |
| Isooctane | 410 | −12 |
| Propylene | 410 | Gas |
| 2-Aminoethanol | 410 | 85 |
| Etylmethacrylate | 410 | 20 |
| ETB | 414 | 55 |
| Nitroethane | 414 | 28 |
| Vinyl chloride | 415 | Gas |
| Methyl acrylate | 415 | −3 |
| 1,3-Butadiene | 415 | Gas |
| Cyclohexanone | 419 | 43 |

TABLE 1-continued

| Substance name | Minimum Ignition temperature C° | Flash point C° |
|---|---|---|
| Isopentane | 420 | <−51.1 |
| Butyl acetate | 420 | 22 |
| Ethanol | 425 | 12 |
| Ethylene | 425 | Gas |
| 2-Propanol | 425 | 12 |
| Isobutanol | 430 | 27 |
| Propylene oxide | 430 | −37.2 |
| Propyl acetate | 430 | 10 |
| Methyl methacrylate | 430 | 10 |
| Ethylbenzene | 431 | 15 |
| Ethylene oxide | 440 | Gas |
| 1,2-Dichloroethane | 440 | 13 |
| Methanol | 455 | 11 |
| MIBK | 458.4 | 18.5 |
| Ethyl acetate | 460 | −4 |
| m-Xylene | 463 | 28 |
| o-Xylene | 465 | 30 |
| Methyl alcohol | 470 | 14 |
| Propane | 470 | Gas |
| Methyl isobutyl ketone | 475 | 14 |
| Methyl acetate | 475 | −10 |
| Acrylonitrile | 480 | −5 |
| 1,2,4-Trimethylbenzene | 485 | 50 |
| Acetic acid | 485 | 40 |
| Cyclopropane | 495 | Gas |
| Methyl ethyl ketone | 505 | −1 |
| Ethyl bromide | 510 | <−20 |
| MEK | 514 | −7 |
| Ethane | 515 | Gas |
| Acetonitrile | 524 | 6 |
| Acetonitrile | 525 | 2 |
| m-Xylene | 525 | 25 |
| p-Xylene | 525 | 25 |
| Naphthalene | 528 | 77 |
| Toluene | 535 | 4 |
| Acetone | 535 | −19 |
| Hydrogen cyanide | 535 | −20 |
| Anone | 540 | 44 |
| Pyridine | 550 | 17 |
| 1,2-Dichloropropane | 555 | 15 |
| Benzene | 555 | −11 |
| Dichloromethane | 556 | — |
| Acetone | 560 | −17 |
| 1,1-Dichloroethylene | 570 | −18 |
| Isopropyl chloride | 590 | −32.2 |
| Chlorobenzene | 590 | 28 |
| Carbon monoxide | 605 | Gas |
| Phenol | 605 | 75 |
| Aniline | 615 | 70 |
| Benzotrifluoride | 620 | 12 |
| Ammonia | 630 | Gas |
| Diacetone alcohol | 640 | 58 |
| o-Dichlorobenzene | 647.8 | 66 |
| Amphetamine | — | 26.7 |
| Cyclobutane | — | Gas |
| Cycloheptane | — | <21 |

TABLE 1-continued

| Substance name | Minimum Ignition temperature C° | Flash point C° |
|---|---|---|
| 1,3-Dioxolane | — | 2 |
| 2-Heptanol | — | 71.1 |
| Propyne | — | — |

FIG. 16A is a reference drawing illustrating compression ratios and changes in the temperature of intake air, by example of a case where the compression ratio of 20:1 with a square bore/stroke ratio. Furthermore, FIG. 16B illustrates a relationship between a non self-ignition region (cleaning agent application and penetration region) (A2) of the cleaning agent (10), a self-ignition area (A3), and a flame propagation region (A4) from an average injection timing (Z) (approximately 12° C. before top dead center) in a stroke (A1) region between top dead center and bottom dead center.

The effect of the solvent (11) that satisfies the characteristics of carbon layer separation and sludge dissolution is allowed to work directly in an overhauling environment. Moreover, a method such as weakening due to penetration over a sufficient time period can be adopted. However, if a method in which this is mixed with the light oil (K) of fuel for injection when the engine is running is used, the temperature reaches approximately 400° C. to 450° C. near top dead center even in a low compression common rail system, and exceeds 500° C. in a general conventional diesel engine. Furthermore, when diffusion combustion starts, the combustion temperature reaches as high as approximately 650° C. Therefore, if the solvent (11) is mixed with fuel and injected in the flame propagation region (A4) after the injection timing (Z), the solvent (11) burns with the light oil (K). Hence, the solvent (11) cannot reach metal surfaces of the inner wall of the cylinder, the valves, and the like. Hence, the solvent (11) cannot exhibit its intrinsic cleaning effect and the like. Furthermore, the amount allowed to blend also needs to be restricted to avoid diesel knock (combustion delay). Hence, a sufficient cleaning effect cannot be obtained. Therefore, there is no cleaning agent that is mixed with fuel and used when the diesel engine is running.

However, under an idea similar to a mixed oil for a two-cycle engine, the satisfaction of the following conditions brings the solvent (11) close to a penetrating state by application at normal temperature. The conditions include that the solvent (11) is attached to the inner wall of the cylinder and the like using the grease (12) as a substitute for an adhesive in the intake and compression strokes before combustion, and that the solvent (11) does not evaporate for a predetermined time under a heating condition of 120° C. to be a temperature of the attached portions. As illustrated in FIG. 16B, the cleaning agent (10) is attached in the non self-ignition region (A2) that occupies from the entire region of the intake stroke to the latter half of the compression stroke. Moreover, the minimum ignition temperature of the solvent (11) is at least 238° C. Hence, the self-ignition region (A3) is located at a position equal to or more than approximately ⅚ stroke. Furthermore, the ignition point of the cleaning agent (10) is 238+a (° C.) due to the blending of the grease (12) having properties as engine oil and a high ignition point. Hence, the ignition point exceeds the ignition temperature characteristic of the light oil (K), and further approaches the flame propagation region (A4). Consequently, a characteristic is presented in which even if the ignition timing comes in the self-ignition region (A3) before the fuel injection timing (Z), the knocking phenomenon does not occur based on the relationship of the flame propagation speed.

Next, as a requirement according to the cleaning agent according to the first aspect of the present invention, it is necessary to include the characteristic that the time taken to vaporize 2.5 cc of the cleaning agent is eight minutes or more in a heated state at 120° C. This is derived from various experiments. This is an essential element to comprehensively exhibit effects such as knock prevention during cleaning, a high cleaning effect, fuel efficiency improvement, reduction of the amount of solvent used, and reduction of particle matter in emission gas. The minimum temperature in the cylinder after warming-up is a high temperature of approximately 90° C. even near bottom dead center. Hence, the temperature increasingly becomes higher toward the cylinder head. The measurement results of the evaporation time in the heated states of 90° C. and 120° C. are illustrated in Table 2. Vege-sol (V) and PAO (P) hardly evaporated even after the elapse of two or more hours. Accordingly, two or more hours is entered. The reasons why the measurements were performed at 90° C. are that the temperature of the coolant flowing out of the water jacket is approximately 90° C., and that the cylinder wall near bottom dead center is a temperature almost approximate to this. Almost similarly, the temperature of lubricating oil is also approximately 90° C. Moreover, the high temperature side is set at 120° C., which is related to the boiling point. The boiling point varies largely depending on the solvent (11). An experiment in a higher temperature range was dangerous under atmospheric pressures.

TABLE 2

| Kind of solvent | 90° C. | 120° C. |
|---|---|---|
| Vege-sol | 2 or more hours | 2 or more hours |
| Butyl CELLOSOLVE | 48 min 16 sec 74 | 23 min 16 sec 40 |
| ETB | 38 min 23 sec 00 | 13 min 36 sec 46 |
| MEK | 23 min 06 sec 09 | 7 min 51 sec 66 |
| Xylene/MEK | 12 min 28 sec 00 | 5 min 06 sec 97 |
| IPA | 2 min 16 sec 16 | 0 min 22 sec 36 |
| Water | 14 min 55 sec 00 | 4 min 29 sec 13 |
| Gasoline | 16 min 32 sec 46 | 4 min 41 sec 33 |
| Kerosene | 1 hr 59 min 44 sec 29 | 23 mi 15 sec 95 |
| n-Hexane | 0 min 22 sec 09 | 0 min 3 sec 95 |
| Mineral terpene | 41 min 41 sec 00 | 18 min 52 sec 76 |
| PAO | 2 or more hours | 2 or more hours |

These solvents (11) were blended with the same mineral oil to observe the cleaning effect experiment results. As a consequence, if, for example, IPA (I) and n-Hexane (N) were attached to an aluminum plate heated to 120° C., they evaporate rapidly. Hence, the cleaning effect was not exhibited at all. In contrast, those having a long evaporation time such as EGBE (B), ETB (E), and Vege-sol (V) were confirmed to exhibit high cleaning effects (see Table 3). From these experiment results, the following can be estimated. That is, the solvent (11) attaches to the combustion chamber and the cylinder by the grease (12) as an adhesive. The solvent (11) remains for a certain period of time, and accordingly, the solvent (11) penetrates the carbon layers. As a consequence, the formability of the carbon layers is promoted to be weakened. The experimental states are illustrated in FIGS. 4A to 4G. A recess with the same hemispheric shape was formed in an aluminum plate. Oil was attached to the recess and heated under the high temperature condition for a long period of time. Artificially attached carbon layers (14) were formed in this manner.

Figure 4:
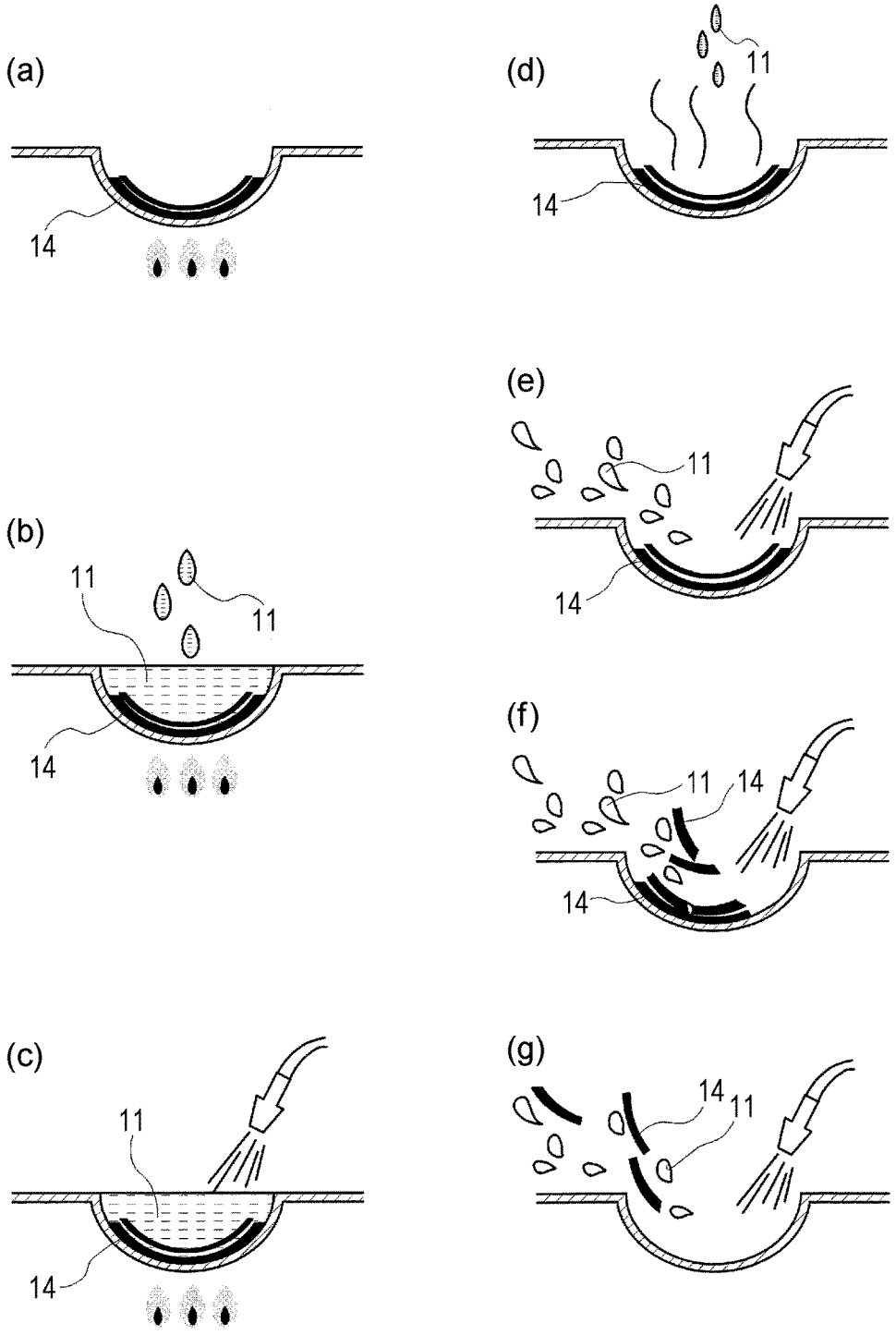
FIGS. 4A to 4G are explanatory views of an experiment on the separation of carbon layers and the like with the cleaning agent according to the present invention.

Furthermore, each type of solvent (11) was injected while the temperature is kept at 120° C. Air at a high pressure of 0.588 Mpa was blown for a moment from 1 cm above after the elapse of a predetermined time. A state where the carbon layers were separated by the blow was observed. FIGS. 4A to 4C are explanatory views of the experiment method. FIGS. 4D to 4G are stylized to describe the outcomes of the experiment results. FIG. 4D illustrates the state of the solvent (11) that evaporates rapidly during injection. FIG. 4E illustrates a state where the solvent (11) does not evaporate, but even if high-pressure air is blown, the artificially attached carbon layers (14) are not separated. FIG. 4F illustrates a state where the solvent (11) does not evaporate for a predetermined time, and accordingly the effect of separating the carbon layers (14) is found.

FIG. 4G illustrates a state where a high separation effect is found. However, in FIGS. 4A to 4G, it is difficult to specifically illustrate the actual separation effects. Hence, the separation states by visual checks are illustrated in Table 3 below. A cross mark (x) represents that the carbon layers were not separated. A triangle mark (Δ) represents that the carbon layers were separated but not excellently. An open-circle mark (○) represents that the carbon layers were separated excellently. A closed circle mark (●) represents that the carbon layers were separated very excellently.

TABLE 3

| | | Kind of solvent | | | | |
|---|---|---|---|---|---|---|
| | | IPA | Hexane | EGBE | ETB | Vege-sol |
| Time | 0 sec | x | x | x | x | x |
| | 1 s | x | x | x | x | x |
| | 3 s | x | x | x | x | x |
| | 9 s | x | x | Δ | Δ | Δ |
| | 27 s | x | x | ○ | ○ | ○ |
| | 1 min | x | x | ○ | ○ | ○ |
| | 4 min | x | x | ○ | ○ | • |
| | 8 min | x | x | • | • | • |

Furthermore, as a requirement of the cleaning agent according to the first aspect of the present invention, it is required that the blending ratio of the solvent (11) to the grease (12) to be mixed in the mixed solution (13) is within a range of 99:1 to 80:20 in the weight ratio. This requirement was also derived from the experiment.

A first reason to specify the blending ratio is to avoid knocking in the compression stroke. For example, if the solvent (11) having a lower ignition temperature than that of the light oil (K), such as n-Hexane (N) or EGBE (B), is singly supplied into a diesel engine (60) from an intake system (61), knocking occurs and the engine is broken. However, the grease (12) is slightly contained in such a solvent (11), and its proportion is gradually increased. Consequently, the knocking is to die down. However, the solvent (11) that is susceptible to evaporation (see Table 3), such as n-Hexane (N), can avoid knocking but can hardly exhibit the cleaning effect as illustrated in FIG. 4D. Hence, n-Hexane (N) is not suitable as a choice of the solvent (11) according to the invention of the present application.

A second reason is to improve the adhesion of the solvent (11). The solvent (11) having a higher ignition temperature than that of the light oil (K), such as ETB (E) or Vege-sol (V), does not have the knocking problem in the compression stroke as in EGBE (B). However, even if ETB (E) and Vege-sol (V), which do not contain the grease (12) at all, are singly used, a sufficient cleaning effect cannot be obtained. However, if a slight amount of the grease (12) is added to the solvent (11), the cleaning effect improves. When the additional amount reaches 1% or more, a sufficient cleaning effect can be obtained. Especially, when the additional amount exceeds approximately 15%, a high cleaning effect is exhibited. A numerical value of 1% seems small. However, even if the mixing ratio of gasoline to oil is 50:1, that is, 2%, sufficient practical performance is satisfied in a two-cycle engine. As described above, even if a proportion of lubricating oil is extremely low as in a ratio of gasoline to lubricating oil of 100:1 or 120:1, sufficient lubricity can be exhibited. This indicates that the lubricating oil is attached to the piston, cylinder, and combustion chamber. However, even if any of the solvents (11) is used, when a proportion of the grease (12) exceeds approximately 20% in the weight ratio, the exhaust gas contains white smoke. The amount of white smoke increases proportional to the content of the grease (12). The white smoke is emitted due to incomplete combustion of the grease (12). The emission of white smoke influences the environment and also harms the health of the worker above everything else. Hence, in the cleaning agent (10) according to the invention of the present application, a blending ratio of the solvent (11) to the grease (12) to be mixed in the mixed solution (13) is specified to be within a range of a ratio of solvent to grease of 99:1 to 80:20 in the weight ratio.

In the cleaning agent (10) according to the second aspect of the present invention, it is required that the solvent (11) is selected in such a manner that the mixed solution (13) has the ignition characteristic and the evaporation characteristic, and the ignition temperature of the mixed solution (13) has an ignition characteristic within a range that does not exceed 480° C. A reason to specify the requirement is to exhibit the effect that the influence of exhaust gas emitted during work on environmental conservation, and the worker's health aspect can be kept to a minimum by the requirement. From the experiment, if one having a characteristic that the ignition temperature exceeds 480° C., for example, MEK (M) (an ignition point of 514° C.) or xylene (KI) (an ignition point of 483° C.) is used as a base of the mixed solution (13), irritation of the worker's eyes disturbs his work. The solvent (11) whose ignition temperature exceeds 600° C., such as acetone, leads to an impossible-to-keep-working situation. Such a phenomenon is considered to occur due to the incomplete combustion of the solvent (11). Hence, in the cleaning agent (10) of the second aspect according to the invention of the present application, in addition to the requirements of the first aspect, it is specified that the ignition temperature does not exceed 480° C.

Right

In the cleaning agent (10) of a third aspect according to the invention of the present application, EGBE (B) is specified as the solvent (11). EGBE (B) has an ignition characteristic closest to that of the light oil (K), and accordingly can easily exceed the ignition temperature of the light oil (K) by being blended with the grease (12). Moreover, EGBE (B) is inexpensive and is excellent in cost performance.

In the cleaning agent (10) of a fourth aspect according to the invention of the present application, ETB (E) is specified as the solvent (11). Unlike EGBE (B), the ignition temperature of ETB (E) is higher than that of the light oil (K) (ignition temperature of 417° C.). Hence, the effect that the knocking problem is hard to arise is exhibited.

In the cleaning agent (10) of a fifth aspect according to the invention of the present application, Vege-sol (V) (Vege-sol is a trademark) is specified as the solvent (11). Vege-sol (V) is slightly costly, but is derived from a plant with vegetable oil (soybean fatty acid ester) as the main component. Hence, from the carbon neutral (carbon neutral) concept, even if Vege-sol (V) is burned, it can be said that a problem against the environment is basically small. Moreover, various experimental results also indicate that a higher cleaning effect than that of EGBE (B) or ETB (E) is exhibited. From the results that evaporation was hardly observed even after two or more hours especially in the evaporation experiment with heating at 120° C., it is considered that the reason is because the time of attachment and penetration to the carbon deposit layers is long.

In the cleaning agent (10) of the sixth aspect according to the invention of the present application, paraffin oil is specified as the grease (12). Paraffin oil is not a special oil. Most of lubricating oils generally used is paraffinic (paraffin rich oil=oil with a high proportion of a paraffin composition). Used is the grease (12) having high lubricity, which is widely used as a base oil for a general engine oil, the base oil being refined by an oil distributor group refiner.

In the cleaning agent (10) of the seventh aspect according to the invention of the present application, naphthenic oil is specified as the grease (12). An engine oil of naphthenic oil (oil with a high proportion of a cyclic composition) does not exist. In view of Japan's amount of distribution and supply, there are only three manufacturers of naphthenic base oils (Union Sekiyu Kogyo Co., Ltd, Taniguchi Petroleum Refining Co., Ltd, and Sankyo Yuka Kogyo K.K.). The naphthenics have a low aniline point and high solubility. Hence, the naphthenics have better compatibility with the solvent (11) than the paraffinic grease (12). Hence, the naphthenics have the features that miscibility, mixing characteristics, and non-separatability, which are required for even dissolution, are high.

In the cleaning agent (10) of an eighth aspect according to the invention of the present application, PAO (P) is specified as the grease (12). While PAO (P) is costly, PAO (P) itself also has a high cleaning effect. Hence, it becomes possible to exhibit a high-level cleaning effect as a carbon and sludge removal action. However, PAO (P) is immediately separated even if being mixed with another solvent (11) to form emulsions. Especially, the separation from EGBE (B) is quick. Hence, the mixing work such as agitation is required during work. However, this problem is solved by using the cleaning agent (10) according to a tenth aspect, or a cleaning system according to a sixteenth or seventeenth aspect.

In the cleaning agent (10) of a ninth aspect according to the invention of the present application, the trade name: Kurisef oil (F) (Kurisef oil is a trademark) of naphthenic raw oil is specified as the grease (12). Kurisef oil is sold by Nippon oil corporation. Kurisef oil can be obtained by carrying out an advanced purification process on naphthene-base crude oil with low sulfur content. Kurisef oil is naphthenic raw oil that is excellent in safety. Kurisef oil is widespread mainly as metal process oil and raw oil for print ink and the like. Hence, Kurisef oil is easy to find and also excellent in cost performance.

Figure 15:
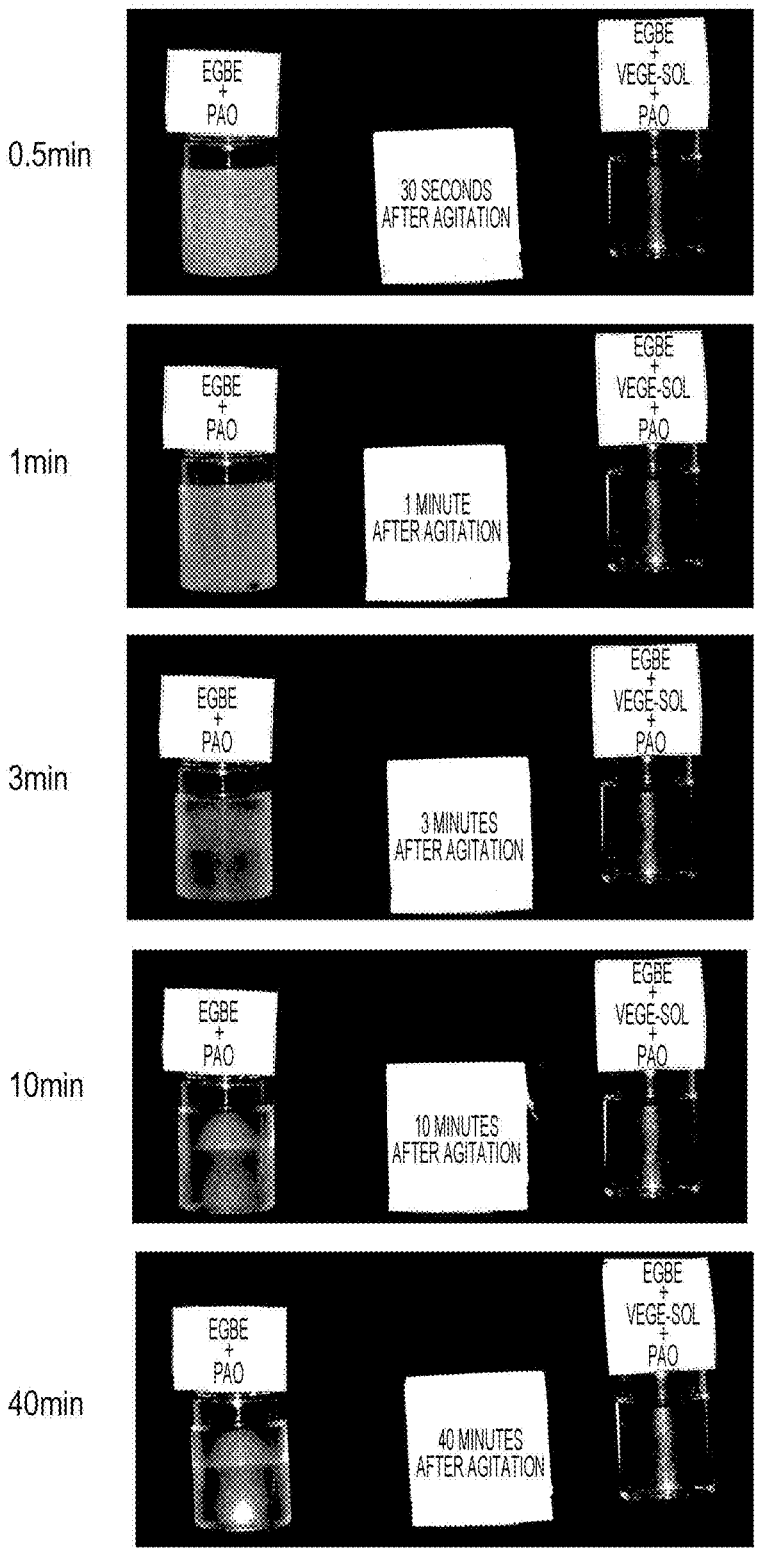
FIG. 15 is an explanatory view of a separation state of a mixed solution according to the present invention with the elapse of time.

In the cleaning agent (10) of the tenth aspect according to the invention of the present application, a solvent in which EGBE (B) and Vege-sol (V) are mixed is specified as the solvent, and PAO (P) as the grease. While PAO (P) is costly, PAO (P) itself also has a high cleaning effect. Hence, a high-level cleaning effect as the carbon and sludge removal action is exhibited. However, PAO (P) is difficult to be mixed with other solvents (11), and is rapidly separated especially from EGBE (B) as described above. Moreover, the separation problem is recognized by some development engineers in the relevant technical field. Under present circumstances, these engineers cannot use PAO (P) even if they want to. However, it is found that if Vege-sol (V) is added to EGBE (B) and PAO (P), the mixed state becomes stable and separation does not occur. FIG. 15 illustrates the state. The agitation of only EGBE (B) and PAO (P) produced turbidity, and they were separated before the elapse of three minutes as illustrated in the left side of FIG. 15. On the other hand, if Vege-sol (V) was added to EGBE (B) and PAO (P) and they were agitated, they became transparent instantaneously. An excellent mixed state was maintained as illustrated in the right side of FIG. 15, and this state lasted for several days after the experiment. Therefore, if the cleaning agent (10) having such a composition is used, there is no need for agitation by, for example, shaking an aerosol can (30) or the like in the middle of work even if the cleaning work is conducted over a long time. Moreover, that only EGBE (B) separated by insufficient agitation is sent into the engine (60) does not occur, either. Hence, an excellent effect that the knocking problem by separated EGBE (B) does not arise either is exhibited.

Figure 5:
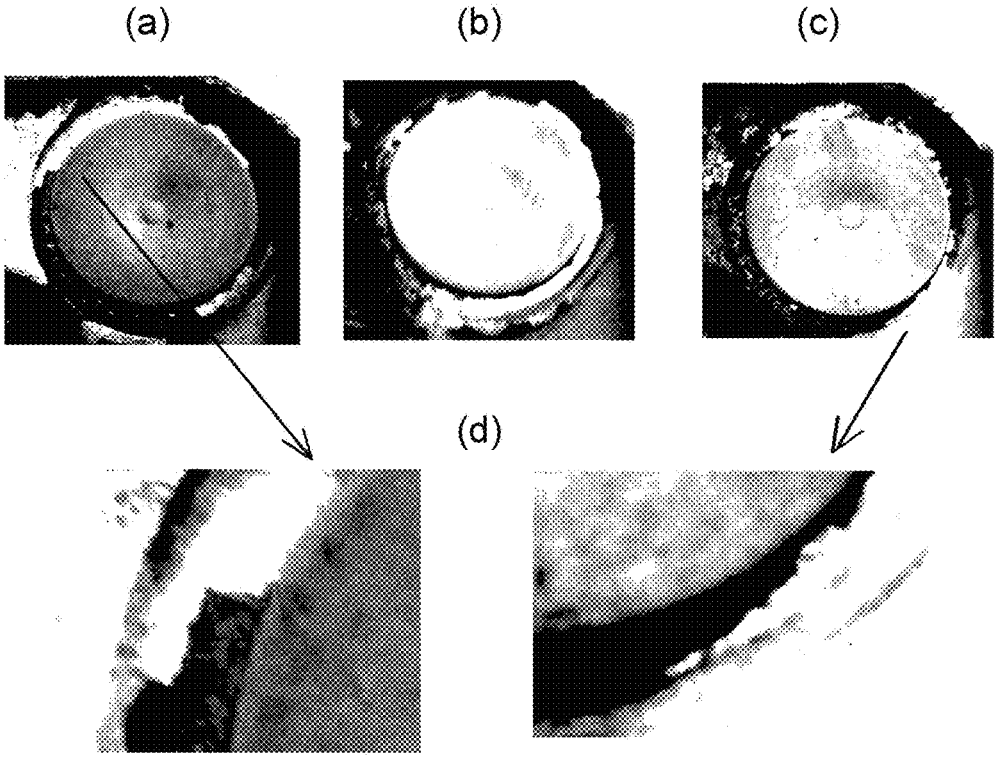
FIGS. 5A to 5D are explanatory views of the state of an actual engine after the cleaning agent according to the present invention is used.

FIGS. 5A to 5D are pictures of the actual diesel engine (60) that has been cleaned by use of the internal cleaning agent for a diesel engine (10) according to the invention of the present application. FIG. 5A illustrates a state after cleaning with EGBE (B) as the solvent (11). FIG. 5B illustrates a state after cleaning with ETB (E) as the solvent (11). FIG. 5C illustrates a state after cleaning with Vege-sol (V) as the solvent (11). Deposited carbon and sludge were cleanly removed from all of them. The exhibition of the effect of the invention of the present application is clearly indicated. Moreover, FIG. 5D illustrates a portion near a valve seat ring of the intake/exhaust valve of each of FIGS. 5A and 5C by enlarging the part. The appearance of the cleaning effect by the chemical action and the cleaning effect by the physical action, which are the characteristics of the invention of the present application, is clearly indicated. A specific description is given. Thin carbon layers remained in portions appearing black. However, the carbon layers were dissolved and removed from most of the parts. This state is similar to a state where the solvent is wiped off after dismantlement and immersion in the solvent for a long time. In other words, the carbon layers were dissolved by a soluble substance in the portions. At the same time, this indicates that the adhesion and penetrability of the cleaning agent according to the invention of the present application are high. The most notable portion is a boundary portion between a portion where the metal surface was completely exposed and the remained thin carbon layers. If observed carefully, it is found that the carbon layers are clearly "missing" in patches. There is a "missing portion" as if the carbon layers had been scraped off with a scraper. This is not the effect of the chemical action by the soluble substance. Indicated is a state where physical shock action such as pulsation, or the like worked on the carbon layers intended to be weakened, and accordingly the carbon layers were separated at the boundary with the metal surface.

Figure 6:
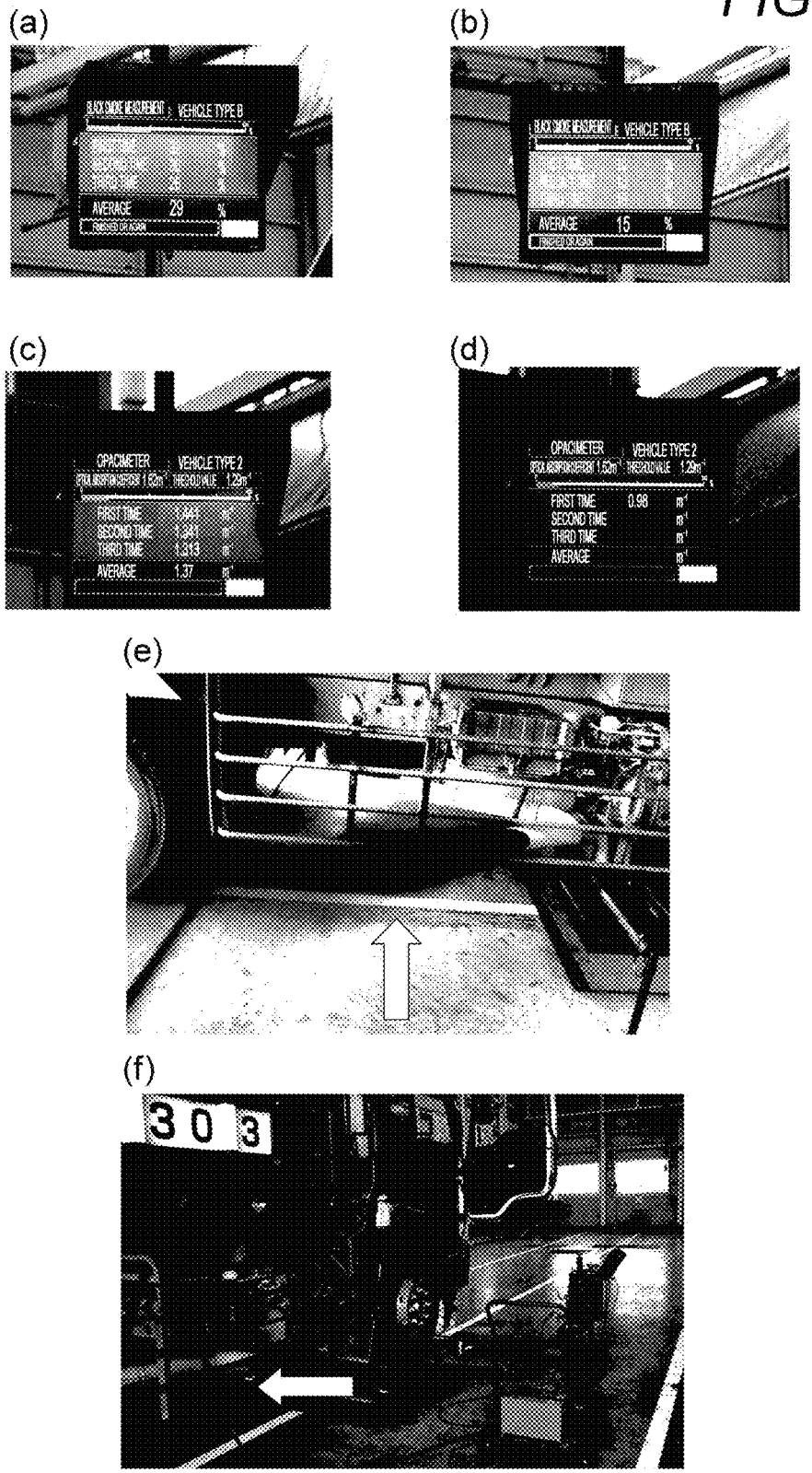
FIGS. 6A to 6F are explanatory views of the effects of the present invention.

FIGS. 6A to 6F are explanatory views of states after the use of the internal cleaning agent for a diesel engine (10) according to the present invention. FIGS. 6A and 6B illustrate the results of measurement of black smoke before and after cleaning FIGS. 6C and 6D illustrate the results of measurement by an opacimeter before and after cleaning FIG. 6E illustrates a state of exhaust gas emitted from an experimental vehicle before cleaning FIG. 6F illustrates a state of exhaust gas emitted from the experimental vehicle after cleaning Arrows illustrated in FIGS. 6E and 6F indicate the states of exhaust gas. It can be seen from the comparison of FIGS. 6E and 6F that jet-black exhaust gas due to black smoke before cleaning was clear after cleaning. The vehicle used for the experiment was a large size truck (Isuzu GIGA V10 19001 cc, a travel distance of approximately 1.3 million km). Measurements were made, respectively, before and after cleaning, and after traveling approximately 20 km immediately after cleaning. The experiment records are illustrated in Table 4 below. Numerical values presented in FIGS. 6B and 6D are the results of measurement after traveling approximately 20 km immediately after cleaning. It can be seen from the comparison of the numerical values before and after cleaning that the value of the black smoke measurement device was reduced by approximately 50%, and the value of the opacimeter by approximately 30% by cleaning with the internal cleaning agent for a diesel engine (10) according to the invention of the present application. In addition, better results were obtained from the measurement after traveling approximately 20 km after cleaning than from the measurement immediately after cleaning. This indicates that the internal cleaning agent for a diesel engine (10) according to the invention of the present application has high adhesion and penetrability and accordingly the weakening of the carbon layers and the like were promoted, and the physical action such as the exhaust pulse worked largely. If most of diesel engine-mounted vehicles running on the roads use such a cleaning agent (10) of the present application that exhibits a high effect, it is needless to say that the black smoke problem can be significantly improved. Moreover, many of vehicles forced to be overhauled due to a failure in the renewal inspection do not need an overhaul. Therefore, the invention of the present application can not only contribute to the social economy, but also improve the environmental deterioration.

TABLE 4

| | Isuzu GIGA V10 19001 cc Traveled 1294602 km | | | | | |
|---|---|---|---|---|---|---|
| | Value of black smoke measurement device | | | Value of opacimeter | | |
| | Before cleaning | Immediately after cleaning | Travelled 20 km after cleaning | Before cleaning | Immediately after cleaning | Travelled 20 km after cleaning |
| First time | 32 | 19 | 15 | 1.441 | 1.19 | 0.93 |
| Second time | 30 | 17 | 15 | 1.341 | 1.10 | 0.98 |
| Third time | 26 | 17 | 16 | 1.313 | 1.18 | 0.98 |
| Average value | 29.3 | 17.6 | 15.3 | 1.365 | 1.15 | 0.96 |
| Reduction rate | | 39.9% | 47.7% | | 15.7% | 29.6% |

Figure 7:
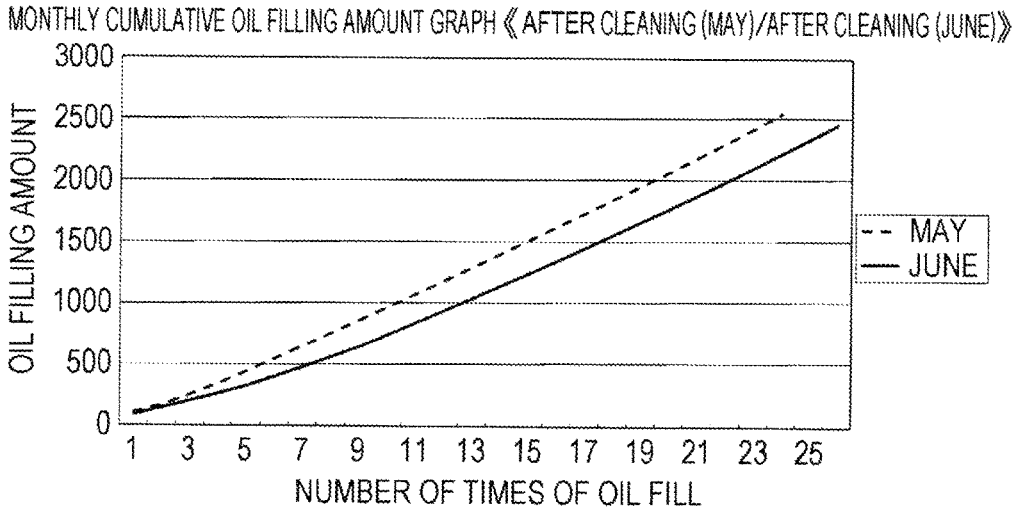
FIG. 7 is a graph illustrating fuel efficiency improvement results according to the present invention.
Figure 8:
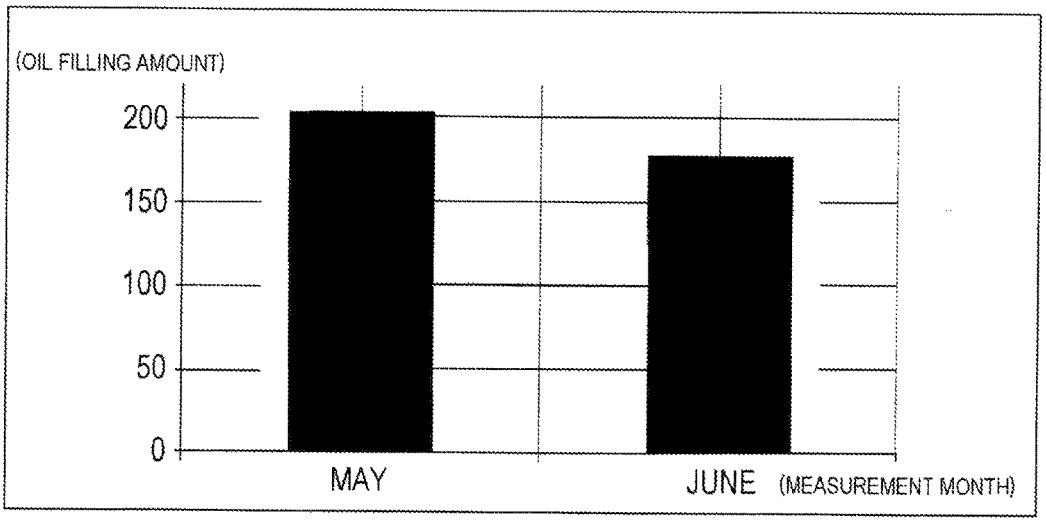
FIG. 8 is a graph illustrating the fuel efficiency improvement results according to the present invention.

FIGS. 7 and 8 compare the amounts of fuel consumption of the vehicle that used the internal cleaning agent for a diesel engine (10) according to the present invention. In these tables, the amounts of fuel consumption for a one-month period after cleaning the engine and for another one-month period after the elapse of one month after cleaning are compared. Specifically, they are results of the experiment conducted using a truck traveling back and forth in the same section every day in the same loading state. Both of the graphs of FIGS. 7 and 8 illustrate the results that an improvement in fuel consumption was promoted better in June that was one month after the cleaning work than in May that was immediately after the cleaning work. This indicates that the effect was continuously exhibited also after the cleaning work. See FIG. 7. To travel the same distance for the same period, 5085 liters were required in May while 4678 liters were sufficient in June. In other words, approximately 410 liters, which is worth filling oil twice, were reduced. Moreover, FIG. 8 is a diagram for comparison by conversion into an oil filling amount per oil fill. An average oil filling amount per oil fill in May is 203.4 liters while an average oil filling amount per oil fill in June is 181.5 liters. In other words, it indicates that the improvement of fuel consumption by approximately 11% was promoted in June. The result does not simply indicate only improvement in fuel efficiency. As described above, it also indicates that long-term weakening of the bonding power of the carbon deposit layers and the like on the cylinder, valve mechanism, and the like was promoted even after the cleaning work.

Figure 9:
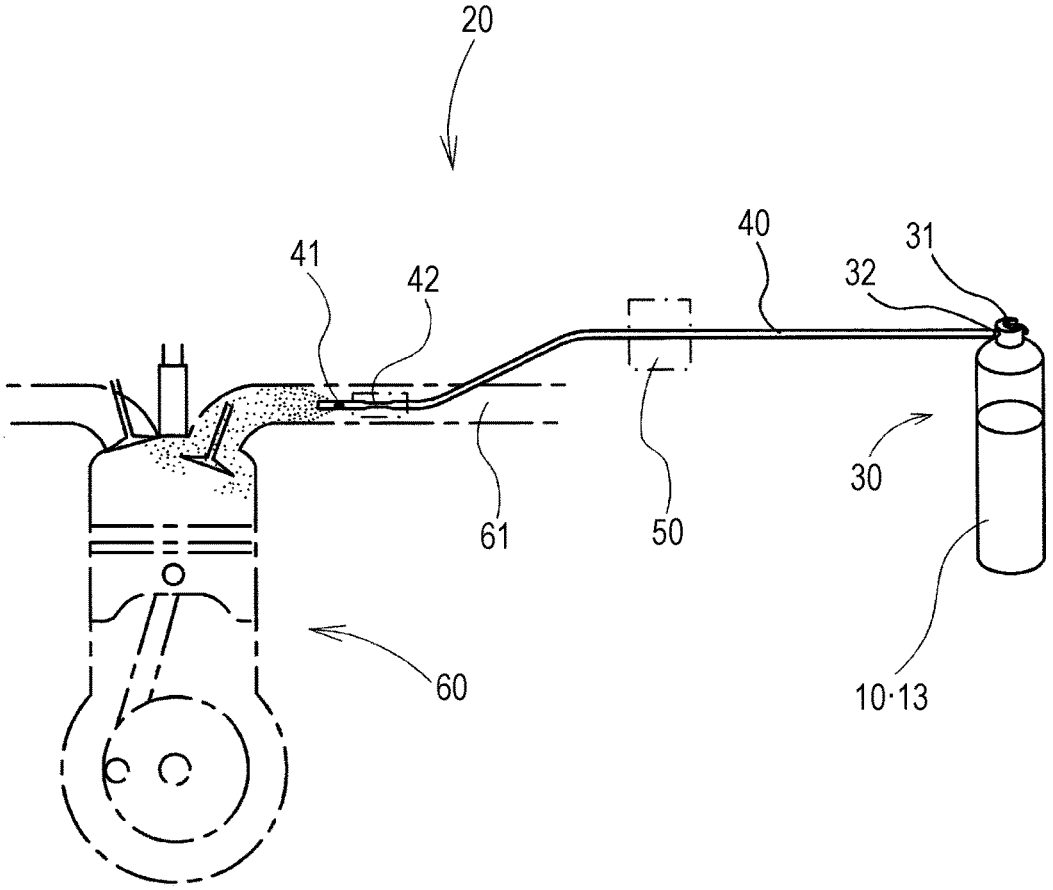
FIG. 9 is an explanatory view of an entire configuration of a cleaning system according to the present invention.

FIG. 9 is an explanatory view of an entire configuration of an internal cleaning system for a diesel engine (20) according to the present invention. The system according to an eleventh aspect includes an aerosol can (30) filled with the internal cleaning agent for a diesel engine (10) according to any of the first to tenth aspects, and a spray-nozzle-equipped hose (40). The aerosol can (30) is provided with an injection state fixing device (31) for maintaining an injection state. A general fixing mechanism that fixes an injection button to inject the filling in the aerosol can (30) in a pushed state, a one-way mechanism, or the like is used for the injection state fixing device (31). Moreover, 0.22 to 0.5 Mpa, in other words, a pressure at which the cleaning agent (10) can be injected from a spray nozzle is sufficient for the internal pressure of the aerosol can (30). In other words, the internal pressure of the aerosol can (30) is not basically set for high-pressure injection into the engine (60). Reaching the inside of the engine (60) by increasing the injection power by the application of high pressure is described in some citations. However, if injected in such a manner in reality, the cleaning agent injected from the nozzle with a force collides with the wall surface of, for example, a bend portion of the intake system (61), and liquefied. Hence, it is not possible to attach the cleaning agent uniformly in the combustion chamber. What is important is to create such an atomized state as to float "lightly" in a high-speed gaseous fluid flowing in the intake system (61), and to carry the atomized state to the inside of the engine along the air flow. Another citation includes a description that the pressure is set low. This is for restricting the supply amount per unit time to prevent knocking and water hammer. Hence, the reason of the low pressure setting is different from the invention of the present application. Moreover, a spray nozzle (41) to be used in the system (20) according to the invention of the present application is provided to a side portion of the hose. This is also to enhance the diffusibility of the atomized fine cleaning agent particles into the high-speed intake air flowing in the intake system (61). Therefore, only a pressure at which the cleaning agent (10) can be sprayed from the spray nozzle (41) is sufficient for the internal pressure of the aerosol can (30). The pressure adjustment is made by a mixing ratio, filling amount, and the like of, for example, butane, propane, or DME (dimethyl ether).

Figure 10:
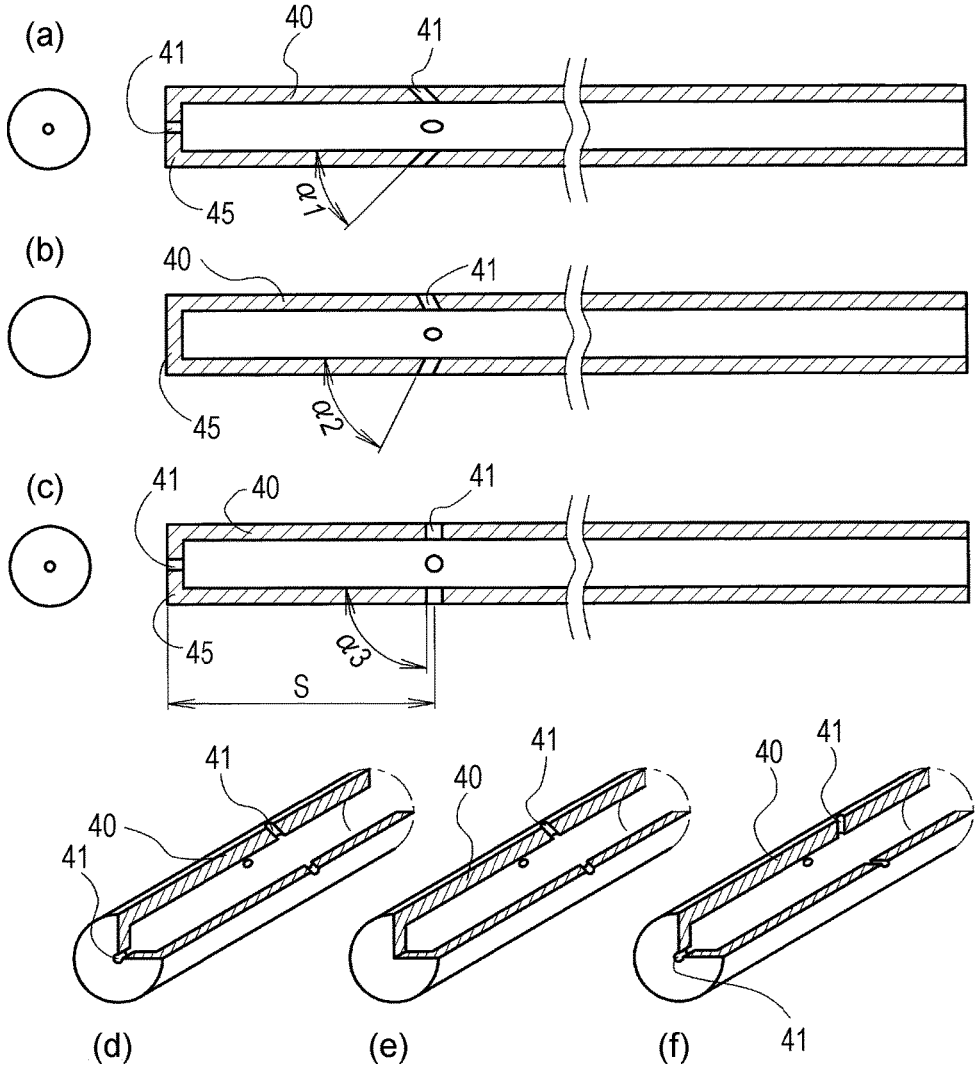
FIGS. 10A to 10F are explanatory views of the shape of a spray nozzle according to the present invention.
Figure 11:
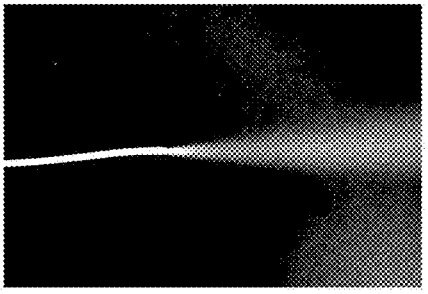
FIGS. 11A to 11D are explanatory views of a spraying state illustrating a state in which the cleaning agent is being sprayed from the spray nozzle.
Figure 11:
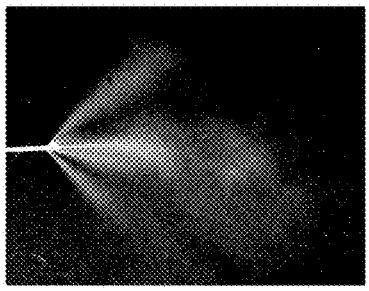
Figure 11:
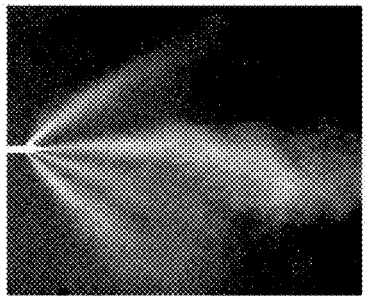
Figure 11:
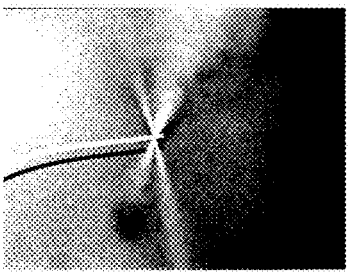

FIGS. 10A to 10F are explanatory views of the shape of the spray nozzle (41) to be used for the internal cleaning system for a diesel engine (20) according to the present invention. FIGS. 10A and 10C illustrate modes including the spray nozzle (41) at a distal end portion (45) of the spray-nozzle-equipped hose (40). FIG. 10B illustrates a mode in which the distal end portion (45) is sealed. Moreover, each of FIGS. 10A to 10C illustrates that a drilled state of the spray nozzle (41) is within a range from 90 degrees ($\alpha$3) orthogonal to the longitudinal direction of the hose to an angle ($\alpha$1) of 45 degrees with respect to a direction toward the inside of the combustion chamber; and a placement state of the spray nozzle (41) at a substantially middle angle ($\alpha$2) between them.

The spray-nozzle-equipped hose (40) has an outer diameter within a range of 2.5 mm to 4.0 mm, and an inner diameter within a range of 1.2 mm to 2.5 mm, and has an oil resistant property and flexibility. A distal end of the hose on a spray side is sealed, and the spray-nozzle-equipped hose (40) includes a plurality of spray nozzles (41) (diameter: 0.1 mm to 0.3 mm) at positions dividing an internal circumference evenly, in a side portion (S) within a range of 5 to 30 mm from the sealed distal end portion (45) to diffuse the internal cleaning agent for a diesel engine (10) into a combustion chamber in an atomized state.

Moreover, the spray-nozzle-equipped hose (40) according to the eleventh aspect is constructed such that the spray nozzle (41) with a diameter of 0.1 mm to 0.3 mm is also provided to a center portion of an end surface of the distal end portion (45). In addition to the spray nozzle (41) provided to the side portion (S), the spray nozzle (41) is provided to improve reachability to the engine (60).

Figure 12:
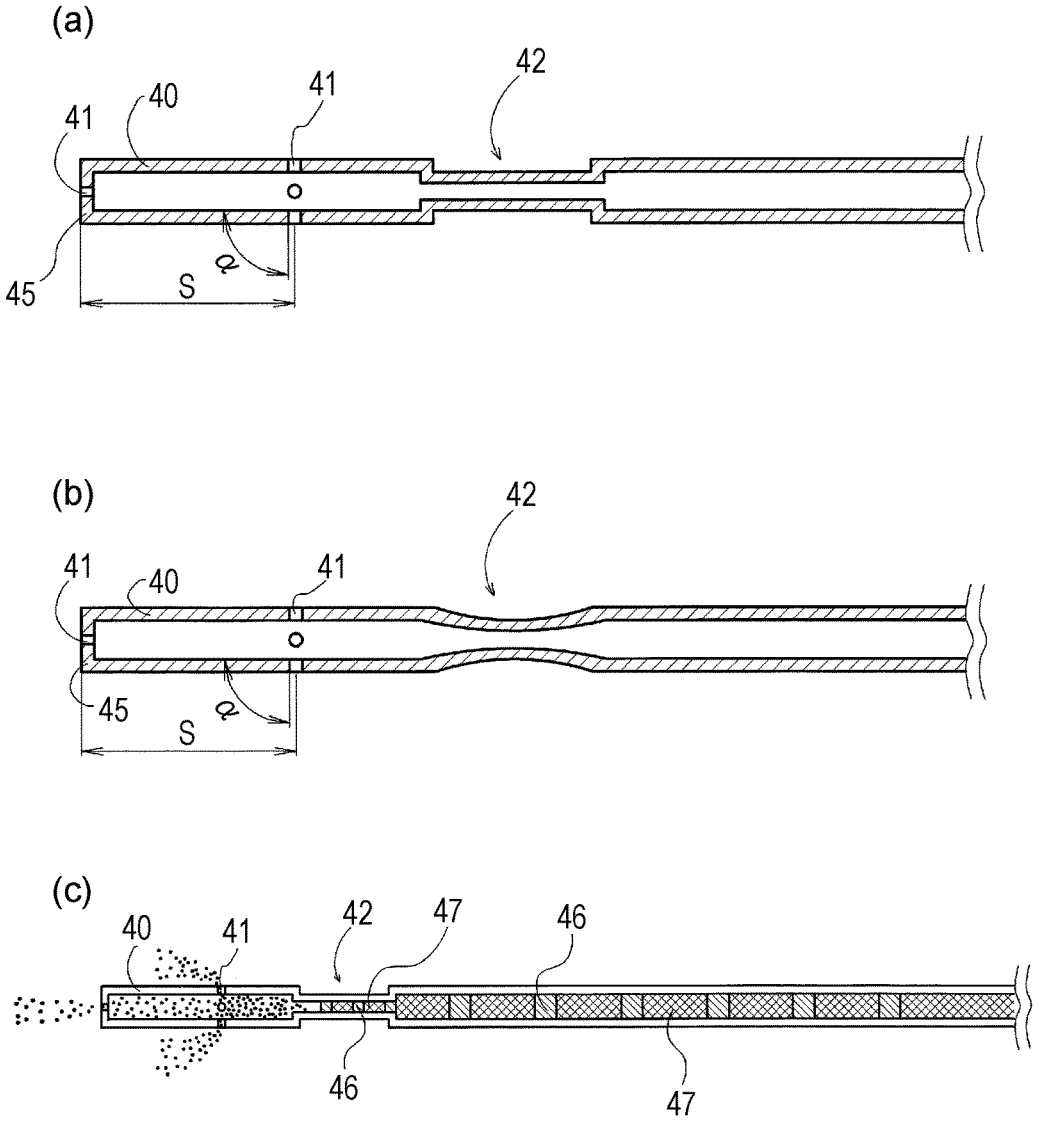
FIGS. 12A to 12C are explanatory views of the shape of a spray-nozzle-equipped hose provided with a venturi portion.

FIGS. 12A to 12C are explanatory views of the shape of the spray-nozzle-equipped hose (40) to which a venturi portion (42) is provided. FIG. 12A illustrates a shape when the venturi portion (42) is formed in a step shape. FIG. 12B illustrates a shape when the shape of the venturi portion (42) is gently constricted. FIG. 12C illustrates the state of a fluid flowing in the conduit. The internal cleaning system for a diesel engine (20) of a twelfth aspect according to the present invention adopts a configuration that the venturi portion (42) is provided at a predetermined position on the aerosol can (30) side from the spray nozzle (41) provided to the side portion (S). With the use of such a configuration, when the cleaning agent (10) passes through the venturi portion (42), the velocity of flow and pressure change. Consequently, the agitation characteristic of the grease (12) and the solvent (11), or the agitation characteristic of the mixed solution (13) and a gaseous body in the aerosol can (30) is improved. The position of the venturi portion (42) is basically a given position. However, the position of the venturi portion (42) is desired to be within a range between 30 mm and 200 mm from the spray nozzle (41) provided to the side portion (S) toward the aerosol can (30) side. Moreover, dimensions that allow an excellent spray state can be selected for the dimensions of the venturi portion (42) according to the inner diameter of the spray-nozzle-equipped hose (40) and the internal pressure of the aerosol can (30). Dimensions that were excellent in the experiment are illustrated. The excellent spray state was obtained with the dimensions of a length 21 mm and inner diameter 0.2 mm of the venturi portion (42) when the inner diameter of the spray-nozzle-equipped hose (40) is 2 mm, and the internal pressure of the aerosol can (10) is 0.32 Mpa (see FIGS. 11A to 11D).

As illustrated in FIG. 12C, when the cleaning agent (10) filled in the aerosol can (30) is sent out via a long nozzle tube, the following phenomenon may occur. In other words, a gas layer (46) of the pressurized and filled gas in the aerosol can (30) and a liquid layer (47) of the cleaning agent in which the gas has been dissolved may pass intermittently and alternately. Such a phenomenon makes the spray state of the cleaning agent (10) unstable, which is not ideal. However, if the configuration in which the venturi portion (42) is provided at the predetermined position of the spray-nozzle-equipped hose (40) is adopted in the internal cleaning system for a diesel engine (20) according to the present invention, the following excellent effect is exerted. In other words, the agitation is conducted by changes in the velocity and pressure of the gas layer (46) and the liquid layer (47) at the time of passing through the venturi portion (42). Consequently, after the gas layer (46) and the liquid layer (47) pass through the venturi portion (42), fine foamy gas is mixed evenly in the cleaning agent. Hence, the cleaning agent (10) in an excellent mist form can be stably and continuously sprayed into the intake system (61).

Moreover, the internal cleaning system for a diesel engine (20) of a fourteenth aspect according to the present invention adopts a configuration that an intermittent injection control device (50) is provided at a given position of the spray-nozzle-equipped hose (40). With the use of such a configuration, a superfluous amount of the cleaning agent (10) is prevented from being sprayed into the engine (60). Furthermore, intermittent injection enables the prolongation of the working time per unit amount. Moreover, the time during which the physical effect works, in other words, the time to apply, to dirt, shocks due to the intake pulse and combustion pressure, can be increased relative to the time during which the chemical effect by the cleaning agent works. Consequently, the absolute amount of the cleaning agent can be reduced. Hence, the proportion of the cleaning agent in the exhaust gas can be reduced. Accordingly, influence on the environment and costs can be reduced. Furthermore, there is an effect to eliminate the waste of the cleaning agent. In other words, waste may be produced in which a new cleaning solution is attached to separated and removed dirt, or dirt immediately before separation and removal before the cleaning effect is fully exerted, and accordingly the cleaning agent is discharged with the dirt before the cleaning effect is exerted. However, the intermittent injection system has the effect of reducing the waste of the cleaning agent. Timer control of a solenoid valve, and the like are conceivable for the intermittent injection.

Figure 13:
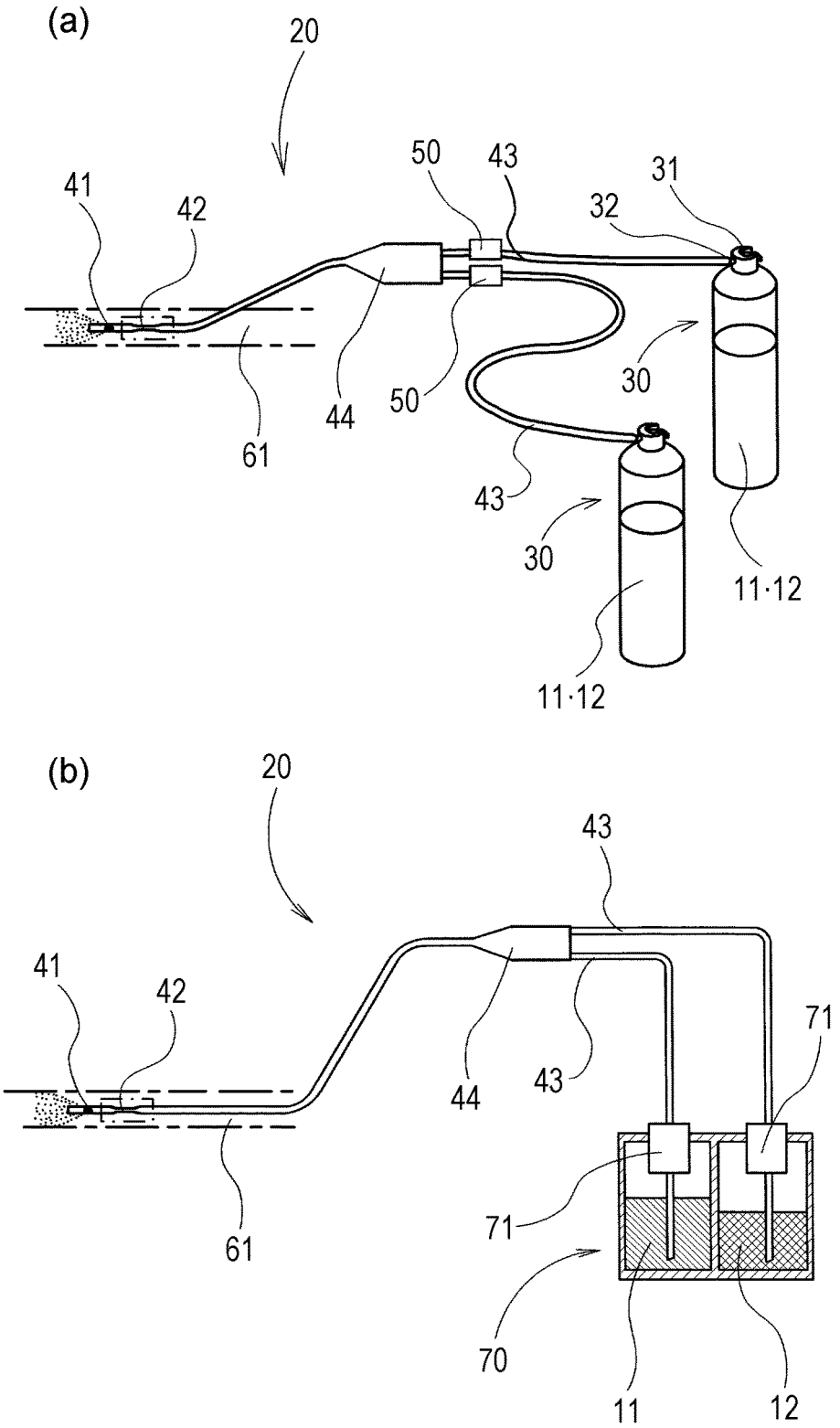
FIGS. 13A and 13B are explanatory views of an entire configuration of another embodiment of an internal cleaning system for a diesel engine according to the present invention.

FIGS. 13A and 13B are explanatory views of an entire configuration of another embodiment of the internal cleaning system for a diesel engine (20) according to the present invention. FIG. 13A is an explanatory view of an entire configuration of the internal cleaning system for a diesel engine (20) according to a fifteenth aspect. FIG. 13B is an explanatory view of an entire configuration of the internal cleaning system for a diesel engine (20) according to the sixteenth aspect.

In the diesel engine internal cleaning removal system (20) according to the fifteenth aspect, two or more aerosol cans (30) are provided, the solvent (11) and the grease (12) that are required to constitute the internal cleaning agent for a diesel engine (10) according to any of the first to tenth aspects are respectively and separately filled in the two or more aerosol cans (30), an end of a separation hose (43) is connected to a spray nozzle (32) of each of the plurality of aerosol cans (30), and the other end of the separation hose is connected to a mixed solution blending portion (44), the mixed solution blending portion (44) integrates the plurality of separation hoses (43), and controls over blending by controlling a solenoid valve in such a manner as to constitute the internal cleaning agent for a diesel engine (10) according to any of the first to tenth aspects, and the mixed solution blending portion (44) is connected to a rear end portion of the spray-nozzle-equipped hose (40).

In the internal cleaning system for a diesel engine (20) according to the sixteenth aspect, a plurality of electromagnetic pump type injection devices (70) is provided instead of the aerosol cans (30), an injection solution container provided in the electromagnetic pump type injection device (70) contains the solvent (11) and the grease (12) that are required to constitute the internal cleaning agent for a diesel engine (10) according to any of the first to tenth aspects, respectively and separately, and inject them to the mixed solution blending portion (44) by an electromagnetic pump (71), and the internal cleaning agent for a diesel engine (10) is sprayed and diffused into the combustion chamber in an atomized state via the spray-nozzle-equipped hose (40) connected to the mixed solution blending portion (44).

Figure 14:
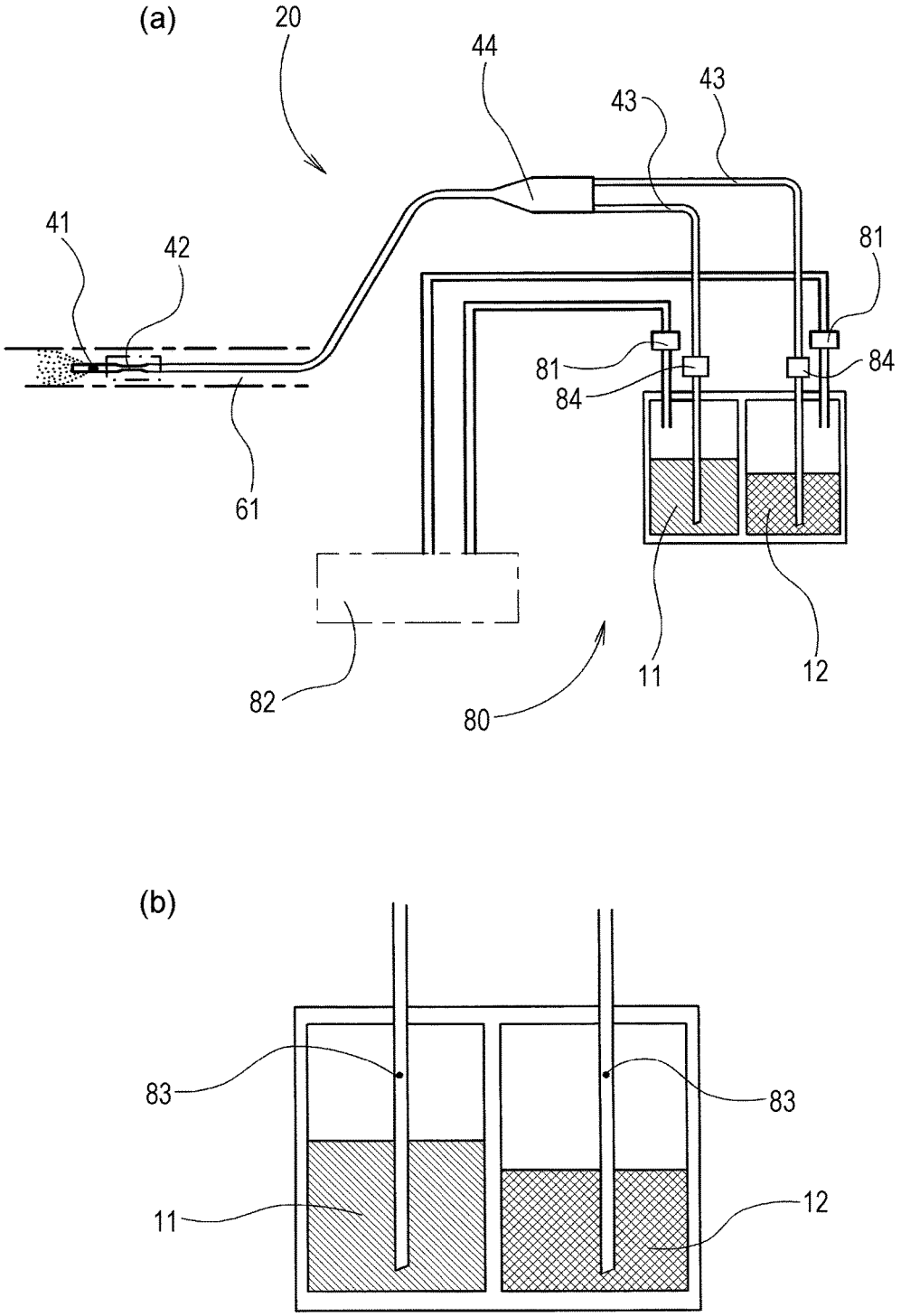
FIGS. 14A and 14B are an explanatory view of an entire configuration of another embodiment of the internal cleaning system for a diesel engine according to the present invention, and an explanatory view of an embodiment when an air introduction hole is provided.

FIGS. 14A and 14B are an explanatory view of an entire configuration of another embodiment of the internal cleaning system for a diesel engine (20) according to the present invention, and an explanatory view of an embodiment when a gas introduction hole (83) is provided. FIG. 14A illustrates the entire configuration of the internal cleaning system for a diesel engine (20) according to the seventeenth aspect. FIG. 14B illustrates an embodiment when the following configuration is adopted. The cleaning system (20) is provided with containers respectively and separately accommodating the solvent (11) and the grease (12). The solvent (11) and the grease (12) are required to form the internal cleaning agent for a diesel engine (10) according to any of the first to tenth aspects in the internal cleaning system for a diesel engine (20) according to the sixteenth or seventeenth aspect. Each container is provided with a conduit inserted through to the bottom of the container. The gas introduction hole (83) for suctioning a part of the gas in the container is provided at a position above the liquid surface on the conduit.

In the internal cleaning system for a diesel engine (20) according to the seventeenth aspect, a plurality of pressurized air type injection devices (80) is provided instead of the aerosol cans (30), a plurality of pressure containers provided in the pressurized air type injection device (80) respectively and separately accommodate the solvent (11) and the grease (12) to form the internal cleaning agent for a diesel engine (10) according to any of the first to tenth aspects, the pressure container is pressurized by pressurized air supplied from an air compressor (82) to inject the solvent and the grease to the mixed solution blending portion (44) via the respective separation hoses (43), and the internal cleaning agent for a diesel engine (10) is sprayed and diffused into the combustion chamber in an atomized state via the spray-nozzle-equipped hose (40) connected to the mixed solution blending portion (44). It is desired to adjust the flow rate of the internal cleaning agent for a diesel engine (10) by an electronically control method with a solenoid valve (84), or by the air to pressurize the inside of the pressure container.

In the internal cleaning system for a diesel engine (20) according to an eighteenth aspect, air for mixture is systematically taken in from each pressure container or each injection solution container into a fluid including the solvent (11) and the grease (12), the fluid flowing in the separation hose (43) and the spray-nozzle-equipped hose (40). Accordingly, such a state where the liquid layer (47) and the gas layer (46) flow alternately as illustrated in FIG. 12C is created in the conduit up to the venturi portion (42). The air is taken in by providing the gas introduction hole (83) at the position above the liquid surface on the conduit inserted through to the bottom of each container. When such a configuration is adopted, even if the solvent (11) and the grease (12) that are to be combined, for example, Vege-sol (B) as the solvent (11) and PAO (P) as the grease (12), are difficult to be mixed and susceptible to separation, the following excellent effect is exhibited. In other words, the solvent (11) and the grease (12) are agitated by changes in velocity and pressure when passing through the venturi portion (42). Consequently, after the solvent (11) and the grease (12) pass through the venturi portion (42), fine foamy gas is mixed evenly in the cleaning agent. Hence, the cleaning agent (10) in an excellent mist form can be stably and continuously sprayed into the intake system (61).

DESCRIPTION OF REFERENCE SIGNS

10 Internal cleaning agent for a diesel engine
11 Solvent
12 Grease
13 Mixed solution
14 Artificially attached carbon layers
20 Internal cleaning system for a diesel engine
30 Aerosol can
31 Injection state fixing device
32 Spray nozzle
40 Spray-nozzle-equipped hose
41 Spray nozzle
42 Venturi portion
43 Separation hose
44 Mixed solution blending portion
45 Distal end portion
46 Gas layer
47 Liquid layer
50 Intermittent injection control device
60 Engine
61 Intake system
70 Electromagnetic pump type injection device
80 Electromagnetic pump
80 Pressurized air type injection device
81 Air regulator
82 Air compressor
83 Gas introduction hole
84 Solenoid valve
α Angle
S Side portion
B EGBE
E ETB
V Vege-sol
N N-Hexane
K Light oil
KI Xylene
I IPA
M MEK
P PAO F Kurisef oil
Z Fuel injection timing
A1 Stroke
A2 Non self-ignition region of light oil (cleaning agent application and penetration region)
A3 Self-ignition region of light oil
A4 Flame propagation region
Z Fuel injection timing

The invention claimed is:

1. An internal cleaning agent for a diesel engine to be sprayed from an intake system with a diesel engine running to clean and remove carbon and sludge deposits on the inside of the engine, the cleaning agent comprising a mixed solution in which a solvent and a grease are blended, wherein
- the solvent includes at least one or more of liquid soluble substances, and
- properties of the solvent includes
  - an ignition point of 238° C. or more,
  - ability of weakening formability of carbon deposit layer by attaching to and penetrating the carbon deposit layer, and
  - exertion of sludge-dissolving power,
- the grease is selected from the group consisting of mineral oil, chemical synthetic oil, semi-synthetic oil, vegetable oil, or a combination thereof, and has a property as an engine oil to be used to improve adhesion and a deposition time of the solvent,
- the mixed solution to be sprayed from an intake system with a diesel engine running is formed by blending the grease and the solvent, and the grease and the solvent are selected in such a manner that the mixed solution has the following properties as well as evaporation characteristics:
  - the properties include igniting at a higher temperature than the ignition characteristic of light oil, and preventing a knocking phenomenon before a fuel injection timing and at the end of the compression stroke from a relationship between the ignition timing and a flame propagation speed, and
  - the evaporation characteristics include an evaporation time of eight minutes or more for vaporizing 2.5 cc of the mixed solution in a heated state at 120° C., and
  - a blending ratio of solvent to grease is within a range of 99:1 to 80:20 in weight ratio.

2. The internal cleaning agent for a diesel engine according to claim 1, wherein the solvent is selected in such a manner that the mixed solution has the characteristic and the evaporation characteristic, and the ignition temperature of the mixed solution has an ignition characteristic within a range that does not exceed 480° C.

3. The internal cleaning agent for a diesel engine according to claim 1, wherein the solvent is ethylene glycol monobutyl ether and
- a the blending ratio of the solvent to the grease is within a range of 95:5 to 80:
- 20 in the weight ratio.

4. The internal cleaning agent for a diesel engine according to claim 1, wherein the solvent is ethylene glycol mono-tertiary butyl ether and
- a the blending ratio of the solvent to the grease is within a range of 99:1 to 80:20 in the weight ratio.

5. The internal cleaning agent for a diesel engine according to claim 1, wherein the solvent is methyl soyate and
- a the blending ratio of the solvent to the grease is within a range of 99:1 to 80:20 in the weight ratio.

6. The internal cleaning agent for a diesel engine according to claim 1, wherein the grease is paraffin oil.

7. The internal cleaning agent for a diesel engine according to claim 1, wherein the grease is naphthenic oil.

8. The internal cleaning agent for a diesel engine according to claim 1, wherein the grease is poly-α-olefin (PAO: poly-α-olefin).

9. The internal cleaning agent for a diesel engine according to claim 1, wherein the grease is a petroleum hydrocarbon mainly of kerosene in viscosity grade range of 8 to 46 of naphthenic raw oil.

10. The internal cleaning agent for a diesel engine according to claim 1, wherein the solvent is a solvent obtained by mixing ethylene glycol monobutyl ether
- the grease is poly-α-olefin (PAO: poly-α-olefin), and
- the blending ratio of the solvent to the oil, which is mixed, is within a range of 95:5 to 80:20 in the weight ratio.

11. An internal cleaning system for a diesel engine for effectively exerting a cleaning effect of an internal cleaning agent for a diesel engine, the system comprising:
- an aerosol can filled with the internal cleaning agent for a diesel engine according to claim 1; and
- a spray-nozzle-equipped hose, wherein
- the aerosol can includes an injection state fixing device for maintaining an injection state,
- the nozzle-equipped hose has an outer diameter within a range of 2.5 mm to 4.0 mm, and an inner diameter within a range of 1.2 mm to 2.5 mm, and has an oil resistant property and flexibility,
- a distal end of the hose on a spray side is sealed,
- the nozzle-equipped hose includes a plurality of spray nozzles (diameter: 0.1 mm to 0.3 mm) at positions dividing an internal circumference evenly, in a side portion within a range of 5 to 30 mm from the sealed distal end portion to diffuse the internal cleaning agent for a diesel engine into a combustion chamber in an atomized state, and
- the spray nozzle is provided in such a drilled manner as to incline divergently toward the distal end at an angle α within a range between 90 degrees orthogonal to a longitudinal direction of the hose and 45 degrees with respect to a direction toward the combustion chamber.

12. The diesel engine internal cleaning system according to claim 11, wherein a spray nozzle (diameter: 0.1 mm to 0.3 mm) is also provided to a center portion on an end surface of the distal end portion of the spray-nozzle-equipped hose.

13. The internal cleaning system for a diesel engine according to claim 11, wherein a venturi portion is provided in the middle between the spray nozzles provided to the side portion of the spray-nozzle-equipped hose and the aerosol can.

14. The diesel engine internal cleaning system according to claim 11, wherein the internal cleaning agent for a diesel engine is intermittently injected by providing an intermittent injection control device.

15. The diesel engine internal cleaning system according to claim 11, wherein
- two or more aerosol cans are provided,
- the solvent and the grease that are required to constitute the internal cleaning agent for a diesel engine are respectively and separately filled in the two or more aerosol cans,
- an end of a separation hose is connected to a spray nozzle of each of the plurality of aerosol cans, and the other end of the separation hose is connected to a mixed solution blending portion,
- the mixed solution blending portion integrates the plurality of separation hoses, and controls over blending by controlling a solenoid valve in such a manner as to constitute the internal cleaning agent for a diesel engine, and the blending portion is connected to a rear end portion of the spray-nozzle-equipped hose.

16. The internal cleaning system for a diesel engine according to claim 11, wherein a plurality of electromagnetic pump type injection devices is provided, the electromagnetic pump type injection device injects the solvent and the grease that are required to constitute the internal cleaning agent for a diesel engine, respectively and separately, to the mixed solution blending portion, and the internal cleaning agent for a diesel engine is diffused into the combustion chamber in an atomized state via the spray-nozzle-equipped hose connected to the mixed solution blending portion.

17. The internal cleaning system for a diesel engine according to claim 11, wherein a plurality of pressurized air type injection devices is provided, a plurality of pressure containers provided in the pressurized air type injection device respectively and separately accommodate the solvent and the grease that are required to form the internal cleaning agent for a diesel engine, the pressure container is pressurized by pressurized air supplied from an air compressor to inject the solvent and the grease to the mixed solution blending portion via the respective separation hoses, and the internal cleaning agent for a diesel engine is diffused into the combustion chamber in an atomized state via the spray-nozzle-equipped hose connected to the mixed solution blending portion.

18. The internal cleaning system for a diesel engine according to claim 16, wherein a gas introduction hole for suctioning a part of gas in the container accommodating the solvent and the grease is provided at a position above a liquid surface on a conduit inserted through to a bottom of the container, the solvent and the grease, or a liquid layer of the mixed solution and a gas layer taken in from the gas in the container, which flow through the spray-nozzle-equipped hose, are alternately created, and a liquid flow and a gas flow pass through the venturi portion and accordingly the gas is mixed in the internal cleaning agent for a diesel engine to facilitate atomization.

19. A method of cleaning and removing carbon and sludge deposits on the inside of a diesel engine, the method comprising:

starting the diesel engine;

while the diesel engine is running, spraying an internal cleaning agent into an intake system of the diesel engine, wherein the internal cleaning agent comprises a mixed solution in which a solvent and a grease are blended, wherein the solvent includes at least one or more of liquid soluble substances, and properties of the solvent includes an ignition point of 238° C. or more, ability of weakening formability of carbon deposit layer by attaching to and penetrating the carbon deposit layer, and exertion of sludge-dissolving power, the grease is lubricating oil comprising any of mineral oil, chemical synthetic oil, semi-synthetic oil, vegetable oil, or a combination thereof, and has a property as an engine oil to be used to improve adhesion and a deposition time of the solvent, the mixed solution is formed by blending the grease and the solvent, and the grease and the solvent are selected in such a manner that the mixed solution has the following properties as well as evaporation characteristics:

the properties include igniting at a higher temperature than the ignition characteristic of light oil, and preventing a knocking phenomenon before a fuel injection timing and at the end of the compression stroke from a relationship between the ignition timing and a flame propagation speed, and the evaporation characteristics include an evaporation time of eight minutes or more for vaporizing 2.5 cc of the mixed solution in a heated state at 120° C., and a blending ratio of solvent to grease is within a range of 99:1 to 80:20 in weight ratio.

* * * * *